US008165502B2

(12) United States Patent
Matsuda

(10) Patent No.: US 8,165,502 B2
(45) Date of Patent: Apr. 24, 2012

(54) BELT DRIVING CONTROLLER, BELT ROTATING DEVICE, AND IMAGE FORMING APPARATUS

(75) Inventor: Hiromichi Matsuda, Kanagawa (JP)

(73) Assignee: Ricoh Company Ltd., Tokyo (JP)

( * ) Notice: Subject to any disclaimer, the term of this patent is extended or adjusted under 35 U.S.C. 154(b) by 1106 days.

(21) Appl. No.: 12/003,816

(22) Filed: Jan. 2, 2008

(65) Prior Publication Data

US 2008/0170884 A1 Jul. 17, 2008

(30) Foreign Application Priority Data

Jan. 15, 2007 (JP) ..... 2007-006413

(51) Int. Cl.
*G03G 15/00* (2006.01)

(52) U.S. Cl. ..... 399/167

(58) Field of Classification Search ..... 347/116; 399/167, 301, 302, 303; 474/22, 69, 70
See application file for complete search history.

(56) References Cited

U.S. PATENT DOCUMENTS

| | | | |
|---|---|---|---|
| 2006/0184258 | A1 | 8/2006 | Matsuda et al. |
| 2006/0275056 | A1 | 12/2006 | Matsuda et al. |

FOREIGN PATENT DOCUMENTS

| | | |
|---|---|---|
| JP | 09-267946 | 10/1997 |
| JP | 10-078734 | 3/1998 |
| JP | 2000-310897 | 11/2000 |
| JP | 2000-330353 | 11/2000 |
| JP | 2004-123383 | 4/2004 |
| JP | 2006-078906 | 3/2006 |
| JP | 2006-119541 | 5/2006 |
| JP | 2006-264976 | 10/2006 |

OTHER PUBLICATIONS

Notice of Rejection of Japanese patent application No. 2007-006413 dated Aug. 23, 2011.

*Primary Examiner* — Mark R Gaworecki
(74) *Attorney, Agent, or Firm* — Harness, Dickey & Pierce, P.L.C.

(57) ABSTRACT

A belt driving controller is disclosed. The belt driving controller controls driving of a belt that is wound around plural sustaining rollers by controlling a driving sustaining roller that transmits a driving force to the belt. In two sustaining rollers, a calculating method for recognizing a PLD (pitch line distance) of the belt is used. In the calculating method, the delay period during which the belt moves a distance from a driven sustaining roller having a large diameter to a driven sustaining roller having a small diameter is determined to be shorter than before in the belt moving direction.

20 Claims, 16 Drawing Sheets

(a)

(b)

BELT DRIVING CONTROLLER, BELT ROTATING DEVICE, AND IMAGE FORMING APPARATUS

BACKGROUND OF THE INVENTION

1. Field of the Invention

The present invention generally relates to a belt driving controller which controls driving of a belt wound around plural sustaining rollers, a belt rotating device using the belt driving controller, and an image forming apparatus using the belt rotating device.

2. Description of the Related Art

As an apparatus which uses belts, there is an image forming apparatus which uses a photoconductor belt, an intermediate transfer belt, a paper carrying belt, and so on. In the image forming apparatus, belt driving control at high accuracy is essential to obtain a high quality image. Especially, in a tandem type image forming apparatus having an image direct transfer system, which has a high image forming velocity and is suitable to be small sized, highly accurate driving control of a paper carrying belt which carries recording paper (recording medium) is required. In a color image forming apparatus, recording paper is carried by a carrying belt and is passed through plural image forming units, each of which forms a different single color image, along a paper carrying direction in order. Then, a color image in which single different color images are superposed can be obtained on the recording paper.

Referring to FIG. 12, an example of the tandem type image forming apparatus having an image direct transfer system using an electro-photographic technology is described. FIG. 12 is a diagram showing a part of the tandem type image forming apparatus which uses a direct image transfer system. As shown in FIG. 12, in the tandem type image forming apparatus, for example, image forming units 18K, 18C, 18M, and 18Y which form single color images of black, cyan, magenta, and yellow, respectively, are sequentially disposed in the paper carrying direction. Electrostatic latent images formed by laser exposure units (not shown) on the surfaces of photoconductor drums 40K, 40C, 40M, and 40Y are developed by the image forming units 18K, 18C, 18M, and 18Y, respectively, and toner images are formed. The toner images are transferred onto recording paper S which is carried by being adhered to a carrying belt 103 by an electrostatic force so that the toner images are superposed in order. Then toners are fused by a fuser (fixing unit) 25 and a color image is formed on the recording paper S. The carrying belt 103 is wound around a driving roller 215 and a driven roller 214 both of which are disposed in parallel with suitable tension. The driving roller 215 is rotated with a predetermined rotation velocity by a driving motor (not shown) and then the carrying belt 103 is moved endlessly with a predetermined velocity. The recording paper S is fed to the image forming units 18K, 18C, 18M, and 18Y with predetermined timing by a paper feeding mechanism (not shown) and is carried at the same velocity as the moving (linear) velocity of the carrying belt 103, and is passed through the image forming units 18K, 18C, 18M, and 18Y in order.

In the tandem type image forming apparatus, when the moving velocity of the recording paper S, that is, the moving velocity of the carrying belt 103 is not sustained at a constant velocity, color registration errors occur. The color registration errors occur when the transferring position of a color image which is superposed on the recording paper S is shifted relative to different color images. When the color registration errors occur, for example, fine-line images formed by superposing plural color images are blurred, and a white part occurs at a position near a contour of a black letter image formed in a background image formed by superposing plural color images. In FIG. 12, the description of the reference number 62 is omitted.

FIG. 13 is a diagram showing a part of a tandem type image forming apparatus which uses an intermediate image transfer system. In the tandem type image forming apparatus shown in FIG. 13, a single color image formed on the surface of each of the photoconductor drums 40K, 40C, 40M, and 40Y in the corresponding image forming units 18K, 18C, 18M, and 18Y is temporarily transferred onto an intermediate transfer belt 10 so that the single color images are sequentially superposed, and the transferred image is recorded on recording paper. That is, the tandem type image forming apparatus shown in FIG. 13 uses the intermediate image transfer system. In this apparatus, when the moving velocity of the intermediate transfer belt 10 is not maintained at a constant velocity, the color registration errors also occur.

In FIG. 13, the description of the reference numbers 9, 14, 15, 16, 24, 25, 49, and 62 is omitted.

In addition to the tandem type image forming apparatuses, in an image forming apparatus which uses belts in a recording medium carrying member which carries a recording medium, a photoconductor body which carries an image to be transferred onto the recording medium, and an image carrier such as an intermediate transfer body, when the moving velocity of a belt is not maintained at a constant value, banding occurs. The banding is image density errors caused by a fluctuation of belt moving velocity while an image is being transferred. That is, when the belt moving velocity is relatively fast, a part of a transferred image is enlarged in the belt moving direction from the original image; on the contrary, when the belt moving velocity is relatively slow, a part of the transferred image is reduced in the belt moving direction from the original image. Therefore, the density of the enlarged part of the image becomes thin and the density of the reduced part of the image becomes thick. As a result, the image density errors occur in the belt moving direction, that is, the banding occurs. When a light single color image is formed, the banding is especially noticeable.

The moving velocity of the belt fluctuates caused by various factors; as one of them, there is thickness unevenness of a belt in the belt moving direction when the belt is a single layer belt. The thickness unevenness of the belt along the belt moving direction (belt circumference direction) is caused when a belt is formed by a centrifugal burning method using a cylindrical die. In a case where the thickness unevenness exists in the belt, when the thick part of the belt is wound around the driving roller which drives the belt, the belt moving velocity becomes faster; on the contrary, when the thin part of the belt is wound around the driving roller, the belt moving velocity becomes slower. That is, the moving velocity of the belt fluctuates. The reasons are described below in detail.

FIG. 14 is a graph showing an example of the belt thickness fluctuation in the moving direction of the intermediate transfer belt 10 shown in FIG. 13. In FIG. 14, the horizontal line shows a belt position in one round of a belt in which the belt circumference length is transformed into the angle of $2\Pi$ rad. The vertical line shows a belt thickness fluctuation (deviation) (μm) from a reference value determined to be 0. In this, actually, the reference value is the belt thickness average value (100 μm) in the belt circumference direction.

In the description of the embodiment of the present invention, in a belt which has the belt thickness unevenness, the belt thickness deviation distribution of the one round in the belt circumference direction is called the belt thickness fluctuation. Therefore, the belt thickness unevenness and the belt thickness fluctuation are described in detail. The belt thickness unevenness shows a belt thickness deviation distribution measured by a film thickness measuring instrument and exists in the belt circumference direction (belt moving direction) and the belt width direction (driving roller axle direction). The belt thickness fluctuation shows a belt thickness deviation distribution caused by the fluctuations of a belt rotation cycle which affects a belt moving velocity for the rotation angle velocity (angular velocity) of the driving roller and the rotation angle velocity of the driven roller for the belt moving velocity where the belt is installed with a belt driving controller.

FIG. 15 is an enlarged view of a part of a belt wound around a driving roller viewed from the axle direction of the driving roller.

In FIG. 15, the moving velocity of a belt 103 is determined by a PLD (pitch line distance) which distance is from the surface of a driving roller 105 to the belt pitch line. When the belt 103 is a single layer belt whose material is uniform and the absolute values of the stretch of the inner and outer circumferences of the belt 103 are almost equal, the PLD corresponds to the distance from the center of the thickness of the belt 103 to the surface of the driving roller 105 (the inner circumference surface of the belt 103) (Bt). Therefore, in a case of the single layer belt, the relationship between the PLD and the belt thickness approximately becomes constant; consequently, the moving velocity of the belt 103 can be determined by the belt thickness fluctuation. However, in a plural-layer belt, since the stretch of the hard layer and the stretch of the soft layer are different from each other, the PLD becomes a distance between a position deviated from the center of the thickness of the belt 103 and the surface of the driving roller 105. Further, in some cases, the PLD changes due to a belt winding angle on (angular range of contact with) the driving roller 105.

$$PLD=PLD_{ave}+f(d) \quad \text{[Equation 1]}$$

Where the $PLD_{ave}$ is an average value of the PLDs in one round of the belt. For example, in a case of a single layer belt whose average thickness is 100 μm, the $PLD_{ave}$ is 50 μM. The f(d) is a function showing a fluctuation of the PLD in one round of the belt, and "d" is a position from a reference on the belt circumference (phase when one round of the belt is defined as 2Π). The f(d) has a high correlation with the belt thickness fluctuation shown in FIG. 14, and a periodic function in which one round of the belt is a period. When the PLD fluctuates in the belt circumference direction, the belt moving velocity or the belt moving distance fluctuates for the rotation angle velocity or the rotation angle displacement of the driving roller, or the rotation angle velocity or the rotation angle displacement of the driven roller fluctuates for the belt moving velocity or the belt moving distance. In FIG. 15, in order to describe the PLD, the reference numbers of the corresponding belt and driving roller are not the same as those shown in FIGS. 12 and 13.

A relationship between the belt moving velocity V and the rotation angle velocity ω of the driving roller 105 is shown in Equation 2.

$$V=\{r+PLD_{ave}+\kappa f(d)\}\omega \quad \text{[Equation 2]}$$

Where "r" is the radius of the driving roller 105. The degree to which the f(d) showing the fluctuation of the PLD influences the relationship between the belt moving velocity or the belt moving distance and the rotation angle velocity or the rotation angle displacement of the roller may change depending on belt contacting conditions and a belt winding amount onto the roller. The influencing degree is shown by a PLD fluctuation effective coefficient "κ".

In the description of the present invention, the range surrounded by { } in Equation 2 is called a roller effective radius. Especially, the constant part ($r+PLD_{ave}$) is called a roller effective radius R. The f(d) is called a PLD fluctuation.

Since the PLD fluctuation f(d) exists in Equation 2, it is understandable that the relationship between the belt moving velocity V and the rotation angle velocity ω of the driving roller 105 changes.

That is, even if the driving roller 105 rotates at a constant rotation angle velocity ω(=constant), the belt moving velocity V is changed by the PLD fluctuation f(d). For example, in a case of a single layer belt, when a part of the belt whose thickness is greater than the average belt thickness is wound around the driving roller 105, the PLD fluctuation f(d) which has a high correlation with the thickness deviation of the belt 103 is a positive value and the roller effective radius increases. Consequently, even if the driving roller 105 rotates at a constant rotation angle velocity (ω=constant), the belt moving velocity V increases. On the contrary, when a part of the belt whose thickness is less than the average belt thickness is wound around the driving roller 105, the PLD fluctuation f(d) is a negative value and the roller effective radius decreases. Consequently, even if the driving roller 105 rotates at a constant rotation angle velocity (ω=constant), the belt moving velocity V decreases.

As described above, even if the rotation angle velocity ω of the driving roller 105 is constant, the belt moving velocity V does not become constant due to the PLD fluctuation f(d). Therefore, if it is attempted to control the driving of the belt 103 by only the rotation angle velocity ω of the driving roller 105, the belt 103 cannot be driven at a desired constant moving velocity.

Further, the relationship between the belt moving velocity V and the rotation angle velocity of the driven roller is the same as that between the belt moving velocity V and the rotation angle velocity ω of the driving roller 105. That is, when the rotation angle velocity of the driven roller is detected by a rotary encoder and the belt moving velocity V is obtained by the detected rotation angle velocity, Equation 2 can be used. For example, in a case of a single layer belt, when a part of the belt whose thickness is greater than the average belt thickness is wound around the driven roller, similar to the case of the driving roller 105, the PLD fluctuation f(d) which has a high correlation with the thickness deviation of the belt 103 is a positive value and the roller effective radius increases. Consequently, even if the belt 103 moves with a constant moving velocity (V=constant), the rotation angle velocity of the driven roller decreases. On the contrary, when a part of the belt whose thickness is less than the average belt thickness is wound around the driven roller, the PLD fluctuation f(d) is a negative value and the roller effective radius decreases. Consequently, even if the belt 103 moves at a constant moving velocity, the rotation angle velocity of the driven roller increases.

As described above, even if the moving velocity of the belt 103 is constant, the rotation angle velocity of the driven roller does not become constant due to the PLD fluctuation f(d). Therefore, even if it is attempted to control the driving of the belt 103 by the rotation angle velocity of the driven roller, the belt 103 cannot be driven at a desired moving velocity.

As a belt driving control technology which considers the PLD fluctuation f(d), an image forming apparatus is disclosed in Patent Documents 1 and 2.

In the image forming apparatus of Patent Document 1, before installing a belt in the image forming apparatus, which belt is formed by a centrifugal forming method in which the PLD fluctuation f(d) is likely to occur in a sine wave in one round of a belt, a thickness profile (belt thickness unevenness) of all the circumference of the belt is measured beforehand in the manufacturing process, and the measured data are stored in a flash ROM. In the image forming apparatus, a reference mark is attached to a home position that is a reference position to match the phase of the profile data of the circumference thickness with the phase of actual belt thickness unevenness. The belt driving control is executed so as to cancel the fluctuation of the belt moving velocity caused by the belt thickness unevenness by detecting the belt thickness unevenness at the reference mark.

In the image forming apparatus of Patent Document 2, a pattern for detection is formed on a belt, the pattern is detected by a detection sensor, and a periodic fluctuation of the belt moving velocity is detected by using the pattern. The belt driving control is executed to cancel the fluctuation of the belt moving velocity caused by the belt thickness fluctuation based on the above detection.

However, in the image forming apparatus of Patent Document 1, it is required to have a process which measures the belt thickness unevenness in the manufacturing process of the belt and a highly accurate thickness measuring instrument is required in the measuring process. Consequently, the manufacturing cost largely increases. In addition, when the belt is changed to a new one, it is required to input the thickness profile data of the new belt in the apparatus. Further, in the image forming apparatus, since the belt thickness unevenness is used without using the PLD fluctuation f(d), in a case of the single layer belt, the belt driving control can be accurately performed, but the belt driving control cannot be performed accurately in a case of the plural-layer belt.

In the image forming apparatus described in Patent Document 2, in order to detect the fluctuation of the belt moving velocity, it is required to form the pattern for detection in at least one round of the belt. Therefore, a large amount of toner is consumed to form the pattern for detection. Especially, in order to detect the fluctuation of the belt moving velocity at high accuracy, when an average value of fluctuation data of the belt moving velocity is obtained by measuring the belt moving velocities of the belt circumference plural times and the average value is used as the fluctuation of the belt moving velocity, the plural patterns for detection of the plural belt circumferences must be formed, and the plural measurements of the belt circumference consume the toner greatly.

In patent document 3, the inventor of the present invention discloses a belt driving controller which can solve the above problems. In the belt driving controller, the rotation angle displacement or the rotation angle velocity of a driven sustaining rotation body is detected, and an alternating current component of the rotation angle velocity of the driven sustaining rotation body having a frequency corresponding to the periodic thickness fluctuation in the belt circumference direction is extracted from the detected data. The amplitude and the phase of the extracted alternating current component correspond to the amplitude and the phase of the periodic thickness fluctuation in the circumference direction of the belt. Therefore, based on the amplitude and the phase of the extracted alternating current component, the rotation angle velocity of a driving sustaining rotation body is controlled to be low at the timing when a thick part of the belt contacts the driving sustaining rotation body and the rotation angle velocity of the driving sustaining rotation body is made high at the timing when a thin part of the belt contacts the driving sustaining rotation body.

According to this technology, the belt can be driven at a desired moving velocity without suffering any influence of the thickness fluctuation in the circumference direction of the belt. Further, it is not necessary to have a process for measuring the belt thickness unevenness in the belt manufacturing process; therefore, the manufacturing cost does not increase, while the cost increases in Patent Document 1. In addition, it is not necessary to have a process for inputting thickness profile data in the apparatus when the belt is changed to a new one. Further, it is not necessary to form a pattern for detection, while it is needed in Patent Document 2. Therefore, toner is not consumed for the belt driving control.

However, in the belt driving controller of Patent Document 3, since the belt thickness fluctuation is approximated by a periodic function; namely, a sine function (cosine function), it is necessary to know the belt thickness fluctuation that occurs in one round of the belt beforehand. That is, it is necessary to know beforehand whether the frequency component included in the belt thickness fluctuation is only a basic frequency component having a cycle equal to the cycle of one round of the belt, or includes a high-frequency component. In addition, in a case of a belt having a seam part, the seam part may thicker than the other parts; then, the belt thickness fluctuation may occur at the seam part. This kind of belt thickness fluctuation is difficult to be approximated by the periodic function.

[Patent Document 1] Japanese Laid-Open Patent Application No. 2000-310897

[Patent Document 2] Japanese Patent No. 3186610

[Patent Document 3] Japanese Laid-Open Patent Application No. 2004-123383 (Japanese Patent No. 3677506)

In order to solve the above problems, the inventor of the present invention discloses a belt driving controller in Japanese Priority Patent Application No. 2005-046548 (hereinafter referred to as a precedent application). The belt driving controller controls driving a belt wound around plural sustaining rotation bodies including a driven sustaining rotation body which are rotated together with a movement of the belt and a driving sustaining rotation body which transfers a driving force to the belt. The belt driving controller includes a control unit. The control unit executes the driving control of the belt so that a moving velocity fluctuation of the belt caused by a PLD fluctuation in the belt circumference direction becomes small, based on rotation information of rotation angle displacement or rotation angle velocities in two of the sustaining rotation bodies in the plural sustaining rotation bodies, in which two sustaining rotation bodies the diameters are different from each other and/or the degrees of the PLDs of belt parts wound around the two rollers influencing a relationship between the belt moving velocity and the rotation angle velocities of the two sustaining rotation bodies are different from each other.

In addition, in the precedent application, a PLD fluctuation recognition method which calculates a control value to restrain the moving velocity fluctuation of the belt is described. In the calculation, an adding process is executed. In the adding process, to the two rotation fluctuation information items whose phases are different from each other included in the rotation information of one or both of the two sustaining rotation bodies, a belt passing through period (delaying period) which is required for the belt to move the distance between the two sustaining rotation bodies on a belt moving route and a gain based on the degrees of the two sustaining rotation bodies are added. The adding process is repeated "n" times (n≧1), and in the adding process, as the gain at the $n^{th}$ adding process, the $2^{n-1}$ power of the gain G of the first adding process is used, and as the delay period of the $n^{th}$ adding process, the $2^{n-1}$ times of the delay period of the first adding process is used.

However, in the adding process of the precedent application, the delay period may become large depending on the positions where the two sustaining rotation bodies are disposed and the moving direction of the belt. When the delay period becomes large, the capacity of a memory unit which is needed for the calculation becomes large. Consequently, a period for calculating a desirable control value becomes large. For example, in the adding process of the precedent application, a calculation block shown by Exp(−τs) corresponds to a memory unit for generating a delay of a phase difference "τ" (delay period), and plural memory units are disposed. When data are sequentially stored in the plural memory units fully, the desirable control value is calculated. Therefore, the calculation period until the desirable control value is calculated greatly depends on the phase difference "τ". The Exp(−τs) is shown in FIG. 3, and the contents in FIG. 3 are described below in detail in the embodiments of the present invention.

In FIG. 6, a part of a belt rotating device is shown. The belt rotating device includes a roller 101 having a small diameter, and a roller 102 having a large diameter, and a belt moving direction is shown by an arrow A. The delay period is a time in which a belt 103 is moved by a distance 205 shown by an alternate long and short dash line. That is, the delay period is the time in which the belt 103 is moved from the roller 101 to the roller 102 along the belt moving direction A. When the belt movement is reversed, the delay period is a time in which the belt is moved by a distance 251 shown by a continuous line from the roller 101 to the roller 102. Generally, the phase difference "τ" corresponds to the delay period. When the delay period is long, the calculation time becomes long and the capacity of the memory unit must be large. In belt driving control in the belt rotating device, the contents in FIG. 6 are described below in detail in the embodiments of the present invention.

SUMMARY OF THE INVENTION

In a preferred embodiment of the present invention, there is provided a belt driving controller, a belt rotating device using the controller, and an image forming apparatus using the device in which a delay period is shortened by determining the delay period to be a time during which a belt is moved from a large diameter roller to a small diameter roller, a target control value is calculated in a short period by using a new calculating method with the shortened delay period, the capacity of a memory unit is decreased by the shortened calculation period, and manufacturing cost of the apparatus is reduced.

Features and advantages of the present invention are set forth in the description that follows, and in part will become apparent from the description and the accompanying drawings, or may be learned by practice of the present invention according to the teachings provided in the description. Features and advantages of the present invention will be realized and attained by a belt driving controller, a belt rotating device using the controller, and an image forming apparatus using the device particularly pointed out in the specification in such full, clear, concise, and exact terms so as to enable a person having ordinary skill in the art to practice the invention.

To achieve one or more of these and other advantages, according to one aspect of the present invention, there is provided a belt driving controller which controls driving of a belt that is wound around plural sustaining rotation bodies including a driven sustaining rotation body that is rotated together with a movement of the belt and a driving sustaining rotation body that transmits a driving force to the belt. The belt driving controller includes a control unit, which controls the driving of the belt so that a moving velocity fluctuation of the belt caused by a PLD fluctuation in the belt circumference direction becomes small, based on rotation information of rotation angle displacements or rotation angle velocities in two of the plural sustaining rotation bodies. In the two sustaining rotation bodies, the diameters are different from each other and/or the degrees to which the PLDs of parts of the belt which parts wind around the two sustaining rotation bodies influence a relationship between the belt moving velocity and the rotation angle velocities of the two sustaining rotation bodies are different from each other. The control unit controls a process, where one value in two pieces of rotation fluctuation information whose phases are different and which information is included in the rotation information of the two sustaining rotation bodies is greater than the other value in the two pieces of the rotation fluctuation information, by obtaining the two pieces of the rotation fluctuation information, and controls the driving of the belt by using a result of the process.

According to another aspect of the present invention, there is provided a belt rotating device. The belt rotating device includes plural sustaining rotation bodies which are rotated together with a movement of a belt, the belt which is wound around the plural sustaining rotation bodies including a driving sustaining rotation body, a driving source which supplies a driving force to the driving sustaining rotation body for driving the belt, a belt driving controller which controls driving of the belt, and a detecting unit which detects at least one of rotation angle displacements and rotation angle velocities of two of the sustaining rotation bodies, in which two sustaining rotation bodies the diameters are different from each other and/or the degrees to which PLDs or thicknesses of parts of the belt which parts wind around the two sustaining rotation bodies influence a relationship between the belt moving velocity and the rotation angle velocities of the two sustaining rotation bodies are different from each other. The belt driving controller includes a control unit, which controls the driving of the belt so that a moving velocity fluctuation of the belt caused by a PLD fluctuation in the belt circumference direction becomes small, based on the detected rotation angle displacements or the rotation angle velocities. The control unit controls a process so that one value in two pieces of rotation fluctuation information whose phases are different in the two sustaining rotation bodies is greater than the other value in the two pieces of the rotation fluctuation information by obtaining the two pieces of the rotation fluctuation information, and controls the driving of the belt by using a result of the process.

According to another aspect of the present invention, there is provided an image forming apparatus. The image forming apparatus includes a latent image carrier formed of a belt which is wound around plural sustaining rotation bodies, a latent image forming unit which forms a latent image on the latent image carrier, a developing unit which develops the latent image formed on the latent image carrier, a transferring unit which transfers the developed latent image onto a recording medium, and the belt rotating device as described above for driving the latent image carrier.

EFFECT OF THE INVENTION

According to an embodiment of the present invention, by utilizing the fact that the degrees, to which a belt thickness fluctuation (PLD fluctuation) influences a relationship between a roller rotation angle velocity and a belt moving velocity, are different, the rotation fluctuation information which influences a relationship between rotational angle velocities of the rollers and belt moving velocity is calculated from rotation information of rollers whose diameters are different from each other. With this, even if the PLD fluctuation is complex, the belt can be moved desirably. Since the delay period during which the belt moves a distance from a driven sustaining roller having a large diameter to a driven sustaining roller having a small diameter is shorter than conventionally in the belt moving direction, the calculating period can be reduced and the capacity of a memory unit can be reduced.

BRIEF DESCRIPTION OF THE DRAWINGS

Features and advantages of the present invention will become more apparent from the following detailed description when read in conjunction with the accompanying drawings, in which.

DESCRIPTION OF THE PREFERRED EMBODIMENTS

Best Mode of Carrying Out the Invention

The best mode of carrying out the present invention is described with reference to the accompanying drawings.

Figure 1:
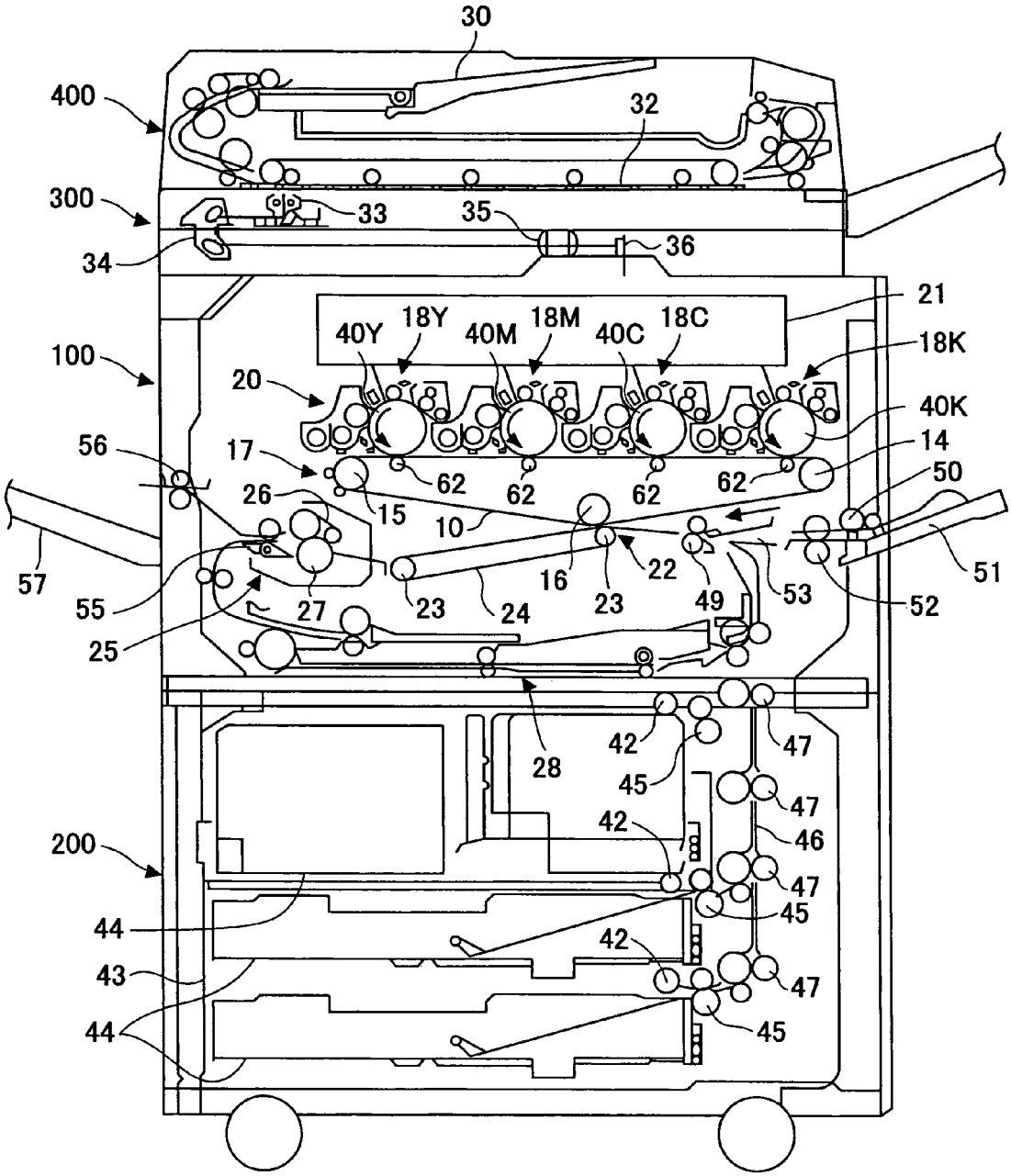
FIG. 1 is a diagram showing an outline of a structure of an image forming apparatus according to an embodiment of the present invention.

FIG. 1 is a diagram showing an outline of a structure of an image forming apparatus according to an embodiment of the present invention. Referring to FIG. 1, the structure of the image forming apparatus is described. In FIG. 1, as the image forming apparatus, a copying machine is used.

The copying machine includes a copying machine main body 100, a paper feeding table 200 on which the copying machine main body 100 is installed, a scanner 300 which is attached to the copying machine main body 100, and an ADF (automatic document feeder) 400 which is disposed on the scanner 300.

The copying machine is an electro-photographic tandem type copying machine which uses an intermediate transfer system (indirect transfer system).

An intermediate transfer belt 10 which is an intermediate transfer body as an image carrier is disposed in the center of the copying machine main body 100. The intermediate transfer belt 10 is wound around first through third sustaining rollers 14, 15, and 16, and is rotated in the clockwise direction in FIG. 1. An intermediate transfer belt cleaning mechanism 17, which removes remaining toner on the intermediate transfer belt 10 after transferring an image, is disposed at the left side of the second sustaining roller 15. A tandem type image forming section 20 in which a yellow image forming section 18Y, a magenta image forming section 18M, a cyan image forming section 18C, and a black image forming section 18K are arrayed is disposed so as to face a part of the intermediate transfer belt 10 which part is disposed between the first sustaining roller 14 and the second sustaining roller 15. In the present embodiment, the third sustaining roller 16 is a driving roller. In addition, an exposure unit 21, which is a latent image forming unit, is disposed above the tandem type image forming section 20.

Further, a secondary image transfer mechanism 22 (secondary image transfer unit) is disposed under the intermediate transfer belt 10, that is, at the side opposite the tandem type image forming section 20 viewed from the intermediate transfer belt 10. In the secondary image transfer mechanism 22, a secondary transfer belt 24, which carries a recording medium, is wound around two rollers 23. The secondary transfer belt 24 is pushed to the third sustaining roller 16 via the intermediate transfer belt 10. An image on the intermediate transfer belt 10 is transferred onto a sheet which is a recording medium by the secondary image transfer mechanism 22. A fixing unit 25, which fixes the image transferred onto the sheet, is disposed at the left side of the secondary image transfer mechanism 22. In the fixing unit 25, a pressure applying roller 27 is pushed to a fixing belt 26. The secondary image transfer mechanism 22 includes a sheet carrying mechanism for carrying the sheet on which the image is transferred to the fixing unit 25. The secondary image transfer mechanism 22 may include a transfer roller and a charger of a non-contact type; however, in this case, it is difficult to include the sheet carrying mechanism. In addition, a sheet reversing mechanism 28, which reverses the sheet so as to record information on both sides of the sheet, is disposed under the secondary image transfer mechanism 22 and the fixing unit 25 at a position parallel to the tandem type image forming section 20.

When a draft (manuscript) is copied by the copying machine, the draft is put on a tray 30 of the ADF 400, or the draft is put on a contact glass 32 of the scanner 300 by opening the ADF 400 and is put in contact with the contact glass 32 by closing the ADF 400. When a start switch (not shown) is pushed, the draft is carried to the contact glass 32 in a case where the draft is put on the tray 30 and the scanner 300 is driven. When the draft is put on the contact glass 32, the scanner 300 is immediately driven. Next, a first moving body 33 and a second moving body 34 are driven. The first moving body 33 emits light from a light source to the draft and reflects light reflected from the draft to the second moving body 34. The second moving body 34 inputs the light reflected from a mirror to a reading sensor 36 via a lens 35 and the contents of the draft are read at the reading sensor 36.

In parallel to the draft reading, the driving roller 16 (third sustaining roller) is driven to rotate by a driving motor (not shown). With this, the intermediate transfer belt 10 is rotated in the clockwise direction, and the first and second sustaining rollers 14 and 15 (driven rollers) are also rotated. At the same time, in the corresponding image forming sections 18Y, 18M, 18C, and 18K; photoconductor drums 40Y, 40M, 40C, and 40K which are latent image carriers are rotated, and on each of the photoconductor drums 40Y, 40M, 40C, and 40K, a single color toner image of corresponding color is formed by exposing and developing corresponding yellow, magenta, cyan, and black information. Toner images on the photoconductor drums 40Y, 40M, 40C, and 40K are sequentially superposed on the intermediate transfer belt 10, and then a color image is formed on the intermediate transfer belt 10.

In parallel to the image forming, one of paper feeding rollers 42 in the paper feeding table 200 is selectively rotated, and many pieces of paper (sheet) are fed from one of paper feeding cassettes 44 disposed in plural in a paper bank 43. Each paper is separated by a separation roller 45, is input to a paper feeding route 46, is carried to a paper feeding route in the copying machine main body 100 by paper carrying rollers 47, and is stopped at registration rollers 49. Alternatively, many sheets of paper are fed from a manual paper inputting tray 51 by rotating a paper feeding roller 50, and each paper is separated by a separation roller 52 and is input in a manually paper feeding route 53 and is stopped at the registration rollers 49. The registration rollers 49 are rotated by meeting the timing of the color image on the intermediate transfer belt 10, the paper is fed between the intermediate transfer belt 10 and the secondary image transfer mechanism 22, and the color image is transferred on the paper by the secondary image transfer mechanism 22. The paper onto which the color image is transferred is carried to the fixing unit 25 by the secondary transfer belt 24, and the fixing unit 25 applies heat and pressure to the paper. When the color image is fixed on the paper, the direction of the paper is changed by a direction changing claw 55 and the paper is output by paper outputting rollers 56 and is stacked on a paper outputting tray 57. Alternatively, the direction of the paper is changed by the direction changing claw 55, the paper is reversed by being input to the sheet reversing mechanism 28, and the paper is input to the transfer position again. After this, another image is recorded on the reverse side of the paper, and the paper is output on the paper outputting tray 57 by the paper outputting rollers 56.

After the image is transferred onto the paper, the intermediate transfer belt cleaning mechanism 17 removes remaining toner on the intermediate transfer belt 10, and the intermediate transfer belt 10 is prepared for the next image forming by the tandem type image forming section 20. In this, the registration rollers 49 are generally grounded; however, a bias voltage can be applied to the registration rollers 49 so as to remove paper powder on the paper.

A black monochromatic copy can be obtained by the copying machine. At this time, the intermediate transfer belt 10 is separated from the photoconductor drums 40Y, 40M, and 40C by a moving mechanism (not shown). The photoconductor drums 40Y, 40M, and 40C are temporarily stopped so that only the photoconductor drum 40K for black is driven and is in contact with the intermediate transfer belt 10 so that a black image is formed.

In FIG. 1, the description of rollers 62 is omitted.

Next, a structure of the intermediate transfer belt 10 according to the present embodiment is described. In this, the following description is not limited to the intermediate transfer belt 10 and can be applied to various belts to which driving control is applied.

As the intermediate transfer belt 10, a single layer belt is used whose main material is fluorine-contained resin, polycarbonate resin, polyimide resin, and so on; or a plural-layer elastic belt is used in which all layers or a part of the layers is made of an elastic material. In addition to the intermediate transfer belt 10, a belt used in the image forming apparatus needs to perform plural functions. Recently, in order to perform the plural functions at the same time, a plural-layer belt which has plural layers in the thickness direction of the belt has become greatly used. For example, the intermediate transfer belt 10 needs to have plural properties such as, toner releasing ability, photoconductor nipping ability, durability, anti-tensile ability, high friction ability for a driving roller, low friction ability for a photoconductor body, and so on.

The toner releasing ability is necessary so as to increase transferring ability of a toner image from the intermediate transfer belt 10 onto a recording medium and to increase cleaning ability for removing remaining toner on the intermediate transfer belt 10 after transferring the toner image onto the recording medium.

The photoconductor nipping ability is necessary so as to increase transferring ability of a toner image onto the intermediate transfer belt 10 by tightly fitting the photoconductor drums 40Y, 40M, 40C, and 40K to the intermediate transfer belt 10.

The durability is necessary because it makes the service life long by decreasing cracks and wearing with the passage of time and makes the running cost low.

The anti-tensile ability is necessary because it prevents the stretch of the intermediate transfer belt 10 in its circumference direction and accurately maintains the belt moving velocity and the belt moving position.

The high friction ability for a driving roller is necessary because it realizes the stable and high accurate movement of the intermediate transfer belt 10 by preventing the intermediate transfer belt 10 from being slid on the driving roller 16.

The low friction ability for a photoconductor body is necessary because it makes load fluctuation low due to generating sliding contact between the photoconductor drums 40Y, 40M, 40C, and 40K and the intermediate transfer belt 10 even if a velocity difference is generated between them.

In order to realize the above properties with a high level at the same time, an intermediate transfer belt of plural layers (described below) is used.

Figure 16:
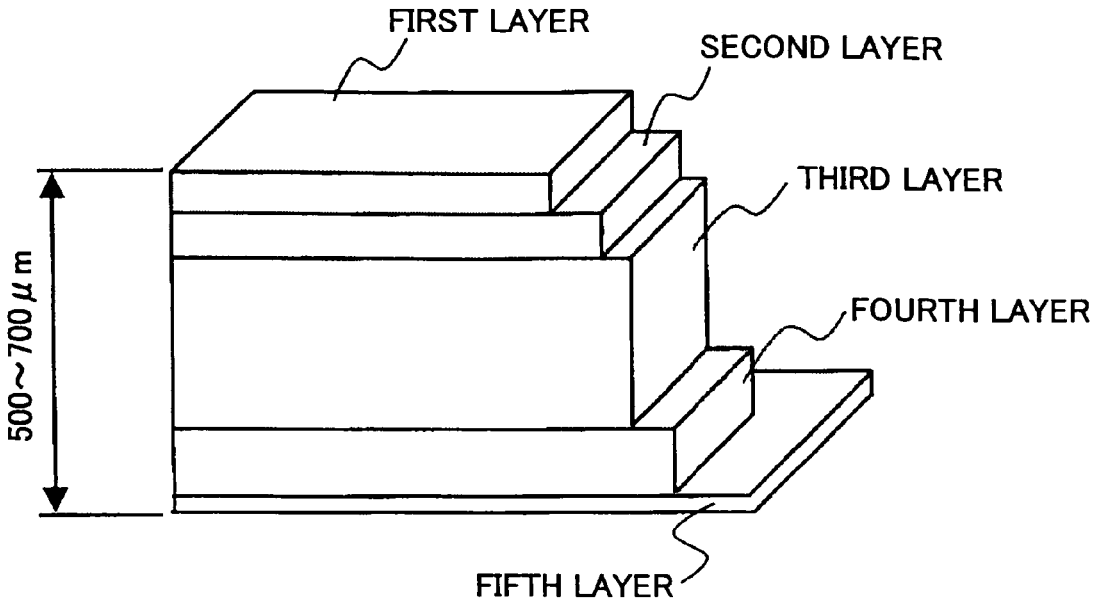
FIG. 16 is a diagram showing an example of a layer structure of the intermediate transfer belt shown in FIG. 13.

FIG. 16 is a diagram showing an example of a layer structure of the intermediate transfer belt 10. In FIG. 16, the intermediate transfer belt 10 is an endless belt having a five-layer structure each layer of which is made of a different material; the thickness of the intermediate belt 10 is 500 to 700 μm or less. The intermediate transfer belt 10 is formed of a first layer, a second layer, a third layer, a fourth layer, and a fifth layer in the order from the belt surface which contacts the photoconductor drums.

The first layer is a coated layer to which polyurethane resin contained fluorine is applied. The low friction ability between the photoconductor drums 40Y, 40M, 40C, and 40K, and the intermediate transfer belt 10 and the toner releasing ability are realized by the first layer.

The second layer is a coated layer to which silicon-acrylic copolymer is applied and works to increase the durability of the first layer and to prevent the degradation of the third layer with the passage of time.

The third layer is a rubber layer (elastic layer) made of chloroprene of 400 to 500 μm thickness and the Young's modulus is 1 to 20 Mpa. Since the intermediate transfer belt 10 is deformed by a partial rugged surface caused by a toner image and a recording medium having low smoothness at the secondary image transfer mechanism 22, the third layer works to restrain a drop of a letter without making transfer pressure excessively high for the toner image. In addition, since excellent tight fitting to the recording medium having low smoothness can be obtained by the third layer, a transfer image having excellent homogeneity can be obtained.

The fourth layer is a polyvinylidene fluoride layer of approximately 100 μm thickness and prevents the stretch of the belt in the circumference direction. The Young's modulus is 500 to 1000 Mpa.

The fifth layer is a polyurethane coated layer and realizes a high friction coefficient with the driving roller 16.

In addition to the above materials for the layers, the following materials can be used. In the first and second layers, contamination to the photoconductor body caused by the elastic material must be prevented, toner adhering strength must be lowered by reducing surface friction resistance to the surface of the intermediate transfer belt 10 (for increasing cleaning property), and a toner image must be excellently transferred to a secondary transfer body. Therefore, one or more of polyurethane resin, polyester resin, and epoxy resin can be used for the first and second layers. Further, lubrication must be high by reducing the surface energy. Therefore, one or more of powders or particles of fluorine resin, fluorine compound, carbon fluoride, titanium dioxide, and silicon carbide can be dispersed in the layer; or the same kinds of the above material whose particle diameter is different can be dispersed in the layer. In addition, the surface energy can be reduced by forming a fluorine-rich layer on the surface by applying heat treatment to a fluorine based rubber material.

For the third layer (elastic layer), one or more of the following materials can be used. The materials are butyl rubber, fluorine based rubber, acrylic rubber, EPDM, NBR, acrylonitrile-butadiene-styrene rubber natural rubber, isoprene rubber, styrene-butadiene rubber, butadiene rubber, ethylene-propylene rubber, ethylene-propylene-terpolymer, chloroprene rubber, chlorosulfonated polyethylene, chlorine polyethylene, polyurethane rubber, syndiotactic 1,2-polybutadiene, epichlorohydrine based rubber, silicone rubber, fluorine contained rubber, polysulfide rubber, polynorbonene rubber, hydrogen nitride rubber, thermoplastic elastomer (for example, polystyrene based, polyolefin based, polyvinyl chloride based, polyurethane based, polyamide based, polyurea based, polyester based, and fluorine resin based one).

For the fourth layer, one or more of the following materials can be used. The materials are polycarbonate, fluorine based resin (ETFE, PVDF), polystyrene, chloropolystyrene, poly-α-methylstyrene, styrene-butadiene copolymer, styrene-vinyl chrolide copolymer, styrene-vinyl acetate copolymer, styrene-maleic acid copolymer, styrene-acrylic ester copolymer (styrene-acrylic methyl copolymer, styrene-acrylic ethyl copolymer, styrene-acrylic butyl copolymer, styrene-acrylic octyl copolymer, and styrene-acrylic phenyl copolymer), styrene-methacrylic acid ester copolymer (styrene-methacrylic acid methyl copolymer, styrene-methacrylic acid ethyl copolymer, styrene-methacrylic acid phenyl copolymer), styrene based resin such as styrene-α-chloracryl acid methyl copolymer, styrene-acrylonitrile-acrylic ester copolymer (homopolymer or copolymer including styrene substitute), methacrylic acid methyl resin, methacrylic acid butyl resin, acrylic acid ethyl resin, acrylic acid butyl resin, modified acrylic resin (silicone modified acrylic resin, vinyl chloride resin modified acrylic resin, acrylic urethane resin), vinyl chloride resin, styrene-vinyl acetate copolymer, vinyl chloride-vinyl acetate copolymer, rosin modified maleic acid resin, phenol resin, epoxy resin, polyester resin, polyester-polyurethane resin, polyethylene, polypropylene, polybutadiene, polyvinylidene chloride, ionomer resin, polyurethane resin, silicone resin, ketone resin, ethylene-ethylacrylate copolymer, xylene resin, polyvinyl butyral resin, polyamide resin, and modified polyphenylene oxide resin.

As a method which prevents the stretch of the elastic belt, the fourth layer is formed by a material whose stretch is small, or an stretch preventing material is contained in the core layer of the fourth layer. However, the manufacturing method is not limited to a specific method.

As the material for the core layer, one or two or more of the following stretch preventing materials can be used. As the stretch preventing materials, there are natural fiber, synthetic fiber, inorganic fiber, and metal fiber. As the natural fiber, there are cotton, silk, and so on. As the synthetic fiber, there are polyester fiber, nylon fiber, acrylic fiber, polyolefin fiber, polyvinylalcohol fiber, polyvinyl chloride fiber, polyvinylidene chloride fiber, polyurethane fiber, polyacetal fiber, polyfluoroethylene fiber, phenol fiber, and so on. As the inorganic fiber, there are carbon fiber, glass fiber, boron fiber, and so on. As the metal fiber, there are iron fiber, copper fiber, and so on. One or two or more of the above materials are fabricated to form cloth or yarn and the cloth or the yarn can be used for the core layer. However, the material is not limited to the above. In addition, as a method for twisting filaments of the fiber to form the yarn, there are a single twisting method, a double twisting method, plural-filaments twisting method, and so on; however, any of the methods can be used. Further, two or more of the above fibers can be mixed. Moreover; a conductive process can be applied to the yarn or the cloth. As a method for weaving the cloth by using the yarns, there are a knitting method and so on; however, any of the methods can be used.

When the core layer is formed in the fourth layer, the manufacturing method of the core layer is not limited to a specific method. For example, cloth which is woven in a cylindrical shape is set to a cylindrical die and a coat layer is formed on the cloth, or the cloth of the cylindrical shape is dipped in liquid rubber and so on and one side or both sides of the cloth are coated with coat layers, or a piece of yarn is spirally wound around a die with an arbitrary pitch and a coat layer is formed on the yarn.

A conductive material for adjusting a resistance value is contained in some layers. As the conductive materials, there are carbon black, graphite, metal powder made of, for example, aluminum, and nickel, and conductive metal oxides. As the conductive metal oxides, there are tin oxide, titanium oxide, antimony oxide, indium oxide, potassium titanate, composite oxide of antimony oxide-tin oxide (ATO), and composite oxide of indium oxide-tin oxide (ITO). The conductive metal oxides can be coated by insulation particles such as barium sulfate, magnesium silicate, calcium carbonate, and so on. The conductive materials are not limited to the above.

Figure 15:
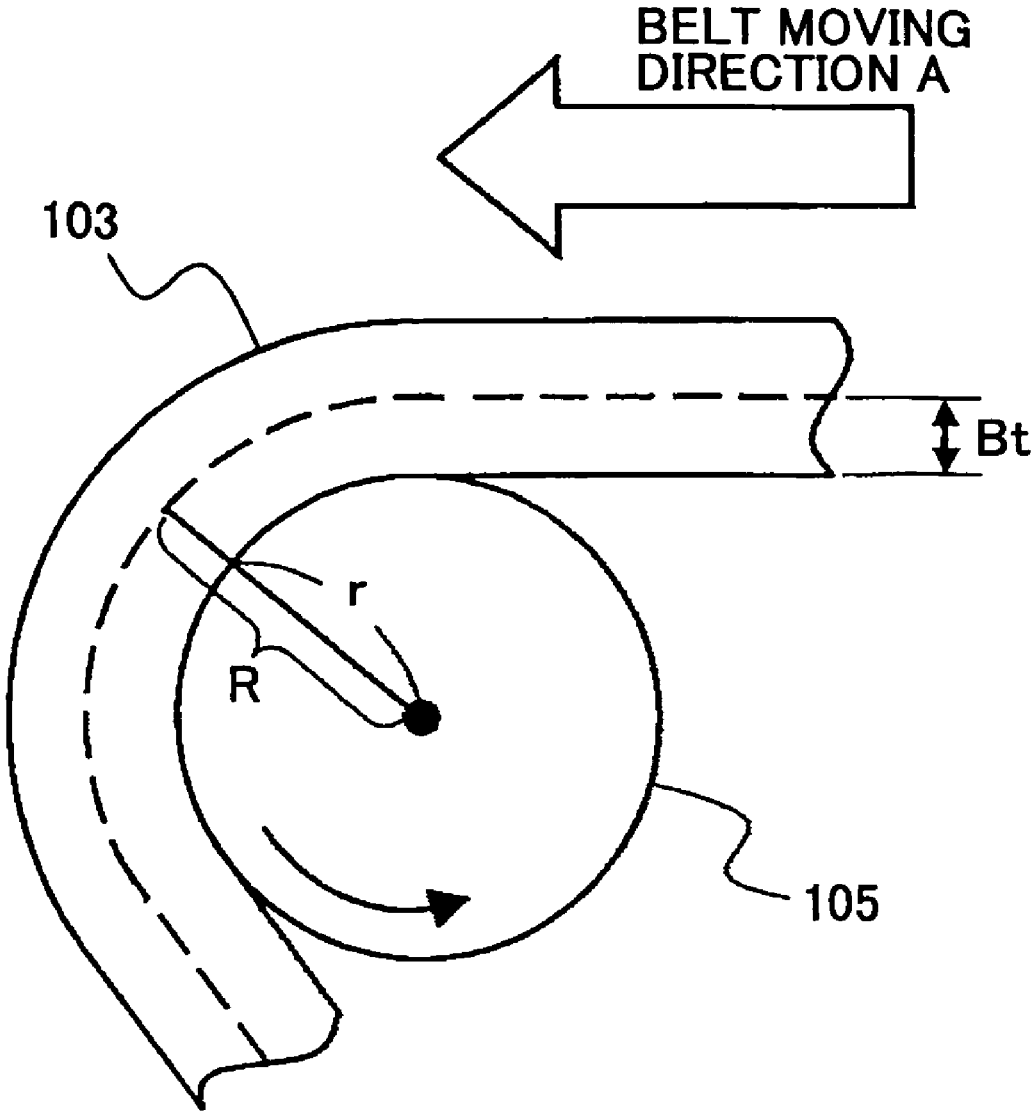
FIG. 15 is an enlarged view of a part of a belt wound around a driving roller viewed from the axle direction of the driving roller.

When the belt is a single layer belt whose material is uniform, since the stretching degrees of the inner and outer circumference surfaces of the belt are the same, as shown in FIG. 15, the belt pitch line which determines the belt moving velocity becomes the center in the belt thickness direction. However, when the belt is a plural-layer belt, the belt pitch line does not become the center in the belt thickness direction. In the plural-layer belt, when a layer whose Young's modulus is remarkably large exists in the plural layers, the belt pitch line exists at an approximately center part of the layer having the large Young's modulus. That is, in order to prevent the stretching of the belt in the belt circumference direction, the belt winds around the sustaining rollers so that the layer having the large Young's modulus becomes the core layer and other layers are stretched or contracted. In this, the layer having the large Young's modulus is called an anti-tensile layer. In the above intermediate transfer belt 10, since the fourth layer (anti-tensile layer) has an extremely large Young's modulus, the belt pitch line exists in the fourth layer. When such an anti-tensile layer whose Young's modulus is extremely high exists in the belt, the thickness unevenness of the anti-tensile layer in the belt circumference direction largely influences the fluctuation of the PLD (pitch line distance). That is, in the plural-layer belt, the PLD is determined while being influenced by a layer having a large Young's modulus in the plural layers.

In addition, when the position of the fourth layer (anti-tensile layer) is displaced in the belt thickness direction around the belt one round, the PLD fluctuates. For example, when the fifth layer which exists between the fourth layer and the sustaining rollers 14 through 16 has thickness unevenness, the position of the fourth layer in the thickness direction changes corresponding to the thickness unevenness of the fifth layer, and the PLD fluctuates.

Further, in a case of an endless belt having a seam part (seam belt), in many cases, the endless belt is manufactured by the following processes. That is, first, a sheet of polyvinylidene fluoride for the fourth layer is formed, and the ends of the sheet are overlapped by approximately 2 mm and are bonded by fusing the sheet; with this an endless sheet is formed. Then other layers are formed on the endless sheet sequentially. In this case, since the material property of the bonded part is changed by fusing and the stretching degree of the bonded part becomes different from the other parts, even if the thickness of the bonded part is the same as that of the other parts, the PLD of the bonded part is largely different from that of the other parts. Even if the belt thickness unevenness does not exist at such a part, the PLD fluctuation occurs and when the part is wound around the driving roller 16, so that the belt velocity fluctuation occurs. In this, in manufacturing a seamless belt, a proper die is required depending on its circumference distance; however, since the seam belt does not need a die and the belt circumference length can be easily adjusted without having a die, manufacturing cost can be lowered.

Next, driving control of the intermediate transfer belt 10 is described.

In the copying machine according to the embodiment of the present invention, the intermediate transfer belt 10 must be moved at a constant velocity. However, actually, the belt moving velocity fluctuates caused by component specification differences, environment changes, and a change with the passage of time. When the belt moving velocity of the intermediate transfer belt 10 fluctuates, an actual belt moving position shifts from a target belt moving position, and the tip position of a toner image on each of the photoconductor drams 40Y, 40M, 40C, and 40K shifts on the intermediate transfer belt 10; consequently, color registration errors are generated. In a case where a toner image is transferred onto the intermediate transfer belt 10 when the belt moving velocity is relatively fast, the toner image transferred onto the intermediate transfer belt 10 is enlarged from the original image in the belt circumference direction; on the contrary, in a case where a toner image is transferred onto the intermediate transfer belt 10 when the belt moving velocity is relatively slow, the toner image transferred onto the intermediate transfer belt 10 is reduced from the original image in the belt circumference direction. In this case, in an image formed on a recording medium, periodic banding (image density errors) appears in the belt circumference direction.

In order to solve this problem, operations and a structure in which the intermediate transfer belt 10 is maintained at a constant velocity at high accuracy is described. In this, the following description is not limited to the intermediate transfer belt 10 and can be applied to various belts to which driving control is applied.

In the present embodiment, in two rollers whose diameters are different from each other, or/and in two rollers, the degrees, to which the PLDs of belt parts wound around the two rollers influence a relationship between the belt moving velocity and the roller rotation angle velocities, are different from each other; therefore, two rotation angle velocities $\omega_1$ and $\omega_2$ of the two rollers are continuously detected. Then, the PLD fluctuation f(t) is obtained from the two rotation angle velocities $\omega_1$ and $\omega_2$. In this, in a case of a single layer belt, the PLD has a constant relationship with the belt thickness and the PLD fluctuation has a constant relationship with the belt thickness fluctuation. Therefore, in two rollers whose diameters are different from each other, or/and in two rollers, the degrees, to which the PLDs of belt parts wound around the two rollers influence a relationship between the belt moving velocity and the roller rotation angle velocities, are different from each other, so that two rotation angle velocities of the two rollers are continuously detected. Then, the belt thickness fluctuation can be obtained from the two rotation angle velocities. The PLD fluctuation f(t) is a periodic function which shows a time change of the PLD at a belt part which passes through a specific point on a belt moving route while the belt moves around. As described above, since the PLD fluctuation f(t) largely influences the belt moving velocity V, the PLD fluctuation f(t) is obtained from the two rotation angle velocities $\omega_1$ and $\omega_2$ of the two sustaining rollers at high accuracy. When belt driving control is executed based on the obtained PLD fluctuation f(t), the belt moving velocity V can be controlled at high accuracy.

Figure 2:
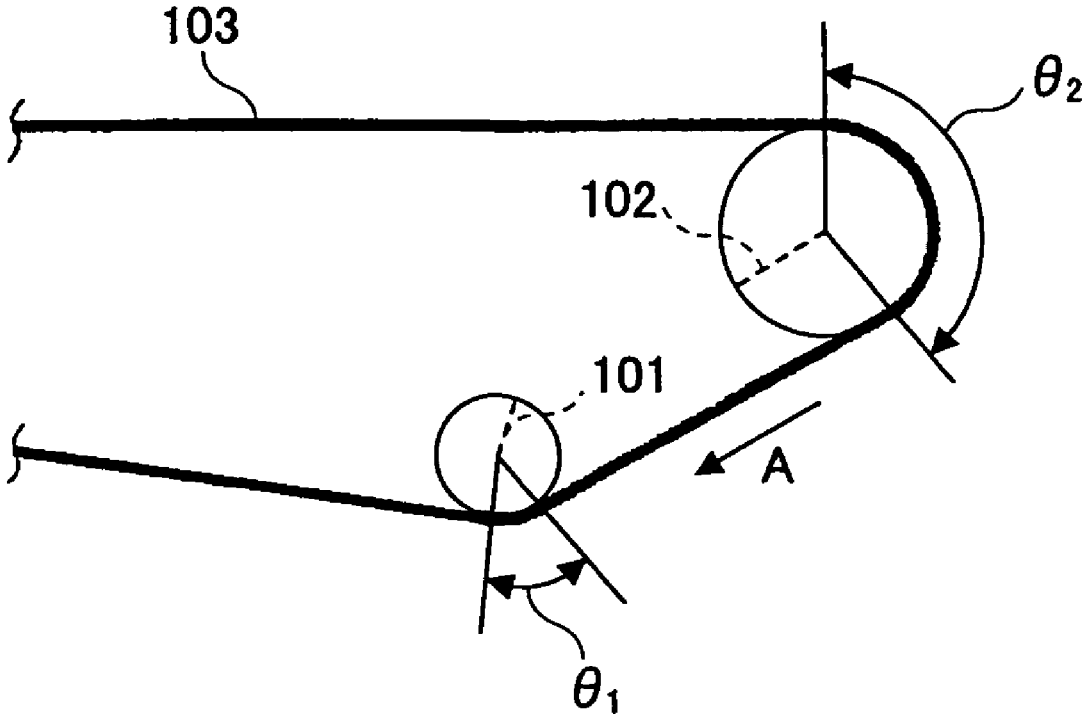
FIG. 2 is a schematic diagram showing a main part of a belt rotating device according to the embodiment of the present invention.

FIG. 2 is a schematic diagram showing a main part of a belt rotating device according to the embodiment of the present invention. The belt rotating device includes a belt 103 and a first roller 101 and a second roller 102 around which the belt 103 is wound and rotated. The belt 103 is wound around the first roller 101 with a belt winding angle $\theta_1$ and is wound around the second roller 102 with a belt winding angle $\theta_2$. The belt 103 endlessly moves in the arrow direction A shown in FIG. 2. A rotary encoder (not shown) which is a detecting unit is disposed in each of the first roller 101 and the second roller 102. The rotary encoders detect the rotation angle displacement or the rotation angle velocity of the corresponding first roller 101 and second roller 102. In the present embodiment, the rotary encoders detect the rotation angle velocity $\omega_1$ of the first roller 101 and the rotation angle velocity $\omega_2$ of the second roller 101 and $\omega_2$, respectively.

As the rotary encoder, an existing optical encoder or an existing magnetic encoder can be used. In the optical encoder, for example, timing marks are formed with a constant interval on a concentric circle of a disk made of a transparent material such as transparent glass or transparent plastic, and the disks are coaxially secured to the first roller 101 and the second roller 102 so that the timing marks are optically detected. In the magnetic encoder, for example, timing marks are recorded magnetically on a concentric circle of a magnetic disk, and the disks are coaxially secured to the first roller 101 and the second roller 102 so that the timing marks are detected by magnetic heads. In addition, as the rotary encoder, an existing tachometer generator can be used. In the present embodiment, for example, a time interval of pulses output continuously from the rotary encoder is measured and the rotation angle velocity is obtained from a reciprocal of the measured time interval. In addition, the rotation angle displacement can be obtained by counting the number of pulses continuously output from the rotary encoder.

The relationship between the rotation angle velocity $\omega_1$ of the first roller 101 and the belt moving velocity V is shown in Equation 3. The relationship between the rotation angle velocity $\omega_2$ of the second roller 102 and the belt moving velocity V is shown in Equation 4.

$$V=\{R_1+\kappa_1 f(t-\tau)\}\omega_1 \quad \text{[Equation 3]}$$

$$V=\{R_2+\kappa_2 f(t)\}\omega_2 \quad \text{[Equation 4]}$$

Where, $R_1$ is the roller effective radius of the first roller 101 and $R_2$ is the roller effective radius of the second roller 102.

In addition, "$\kappa_1$" is a PLD fluctuation effective coefficient of the first roller 101 which is determined by the belt winding angle $\theta_1$, the belt material, the belt layer structure, and so on of the first roller 101, and is a parameter which determines the influencing degree of the PLD on the belt moving velocity V. Similarly, "$\kappa_2$" is a PLD fluctuation effective coefficient of the second roller 102. In Equation 3 and Equation 4, different-PLD fluctuation effective coefficients "$\kappa_1$" and "$\kappa_2$" are used. The reason is as follows. Since the belt winding conditions (deformation curvature) are different and the belt winding amount is different between the first roller 101 and the second roller 102, in some cases, the influencing degree of the PLD fluctuation on the relationship between the belt moving velocity (belt moving amount) and the rotation angle velocity (rotation angle displacement) of the roller is different between the first roller 101 and the second roller 102. In this, when a single layer belt whose material is uniform is used and the belt winding angles $\theta_1$ and $\theta_2$ are sufficiently large, the PLD fluctuation effective coefficients "$\kappa_1$" and "$\kappa_2$" become the same value.

The PLD fluctuation f(t) is a periodic function which shows a fluctuation in time of the PLD of a part of a belt which passes through a specific point on the belt moving route and has the same period of the belt which moves around one round, and shows a deviation from the average $PLD_{ave}$ of the PLDs in the belt circumference direction around the belt one round. In this, the specific point is a position where the belt 103 winds around the first roller 101.

Therefore, when the time t=0, the PLD fluctuation amount of the part of the belt where the belt 103 winds around the first roller 101 becomes f(0). In this, as the function of the PLD fluctuation, instead of the time function f(t), the above described function f(d) can be used. The functions f(t) and f(d) can be mutually converted.

Further, "$\tau$" is an average period that the belt 103 moves from the second roller 102 to the first roller 101, and is called "delay period". The delay period "$\tau$" signifies a phase difference between the PLD fluctuation $f(t-\tau)$ at a part where the belt 103 winds around the first roller 101 and the PLD fluctuation f(t) at a part where the belt 103 winds around the second roller 102.

It is difficult to obtain the average value of the PLDs ($PLD_{ave}$) from only the belt layer structure and the material and property of each layer. However, for example, the $PLD_{ave}$ can be obtained from an average value of the belt moving velocities by executing a simple test which drives the belt.

That is, when a driving roller is driven at a constant rotation angle velocity, the average value of the belt moving velocity is {(driving roller radius "r"+$PLD_{ave}$)×constant rotation angle velocity of driving roller $\omega_{01}$}. Further, when the driving roller is driven at a constant rotation angle velocity, the average value of the belt moving velocity can be obtained from "belt circumference length"/"belt moving time of one round". The belt circumference length and the belt moving time of one round can be accurately measured. Therefore, when the driving roller is driven at a constant rotation angle velocity, the average value of the belt moving velocity can be also calculated accurately. In addition, since the driving roller radius "r" and the constant rotation angle velocity of the driving roller $\omega_{01}$ can be accurately obtained, the $PLD_{ave}$ can be also calculated accurately. In this, the calculating method of the $PLD_{ave}$ is not limited to the above method.

Since the belt moving velocity V of a part where the belt 103 winds around the second roller 102 at the time "t" is the same as the belt moving velocity V of a part where the belt 103 winds around the second roller 102 at the time "t", Equation 5 can be obtained from Equation 3 and Equation 4.

$$\omega_2 = \frac{\{R_1 + \kappa_1 f(t-\tau)\}}{\{R_2 + \kappa_2 f(t)\}}\omega_1 \quad \text{[Equation 5]}$$

Since the PLD fluctuation f(t) is small enough for the roller effective radii $R_1$ and $R_2$, Equation 5 can be approximated to Equation 6.

$$\omega_2 \cong \frac{R_1}{R_2}\omega_1 + \frac{R_1}{R_2}\omega_1\left\{\frac{\kappa_1}{R_1}f(t-\tau) - \frac{\kappa_2}{R_2}f(t)\right\} \quad \text{[Equation 6]}$$

A method for accurately obtaining the PLD fluctuation f(t) from the rotation angle velocity $\omega_1$ of the first roller 101 and the rotation angle velocity $\omega_2$ of the second roller 102 is described. In the following example, a case is described in which the diameter of the second roller 102 is greater than the diameter of the first roller 101. In the case when a value in which the roller effective radius R is divided by the PLD fluctuation effective coefficient "$\kappa$" is obtained (described below in detail in Equation 9), the value of the second roller 102 is greater than the value of the first roller 101. However, in a reverse case, the method can be used.

The relationship between the rotation angle velocity $\omega_1$ of the first roller 101 and the rotation angle velocity $\omega_2$ of the second roller 102 is shown in Equation 6; when Equation 6 is modified, Equation 7 is obtained.

$$\left(\frac{R_2}{R_1}\omega_2 - \omega_1\right)\frac{R_2}{\omega_1\kappa_2} = \left\{\frac{\kappa_1 R_2}{\kappa_2 R_2} f(t-\tau) - f(t)\right\} \quad \text{[Equation 7]}$$

When the right side of Equation 7 in which the coefficient of f(t) is normalized as 1 is defined as gf(t), Equation 8 is obtained. The gf(t) is rotation information.

$$gf(t)=\{Gf(t-\tau)-f(t)\} \quad \text{[Equation 8]}$$

Where "G" in Equation 8 is shown in Equation 9.

$$G = \frac{\kappa_1 R_2}{\kappa_2 R_2} = \frac{\frac{R_2}{\kappa_2}}{\frac{R_1}{\kappa_1}} \quad \text{[Equation 9]}$$

From the relationship between the roller effective radius R and the PLD fluctuation effective coefficient κ in each of the first roller 101 and the second roller 102, "G" is a value greater than 1. In addition, from Equation 7, the gf(t) is obtained from the rotation angle velocities $\omega_1$ and $\omega_2$ of the first roller 101 and the second roller 102 by using the roller effective radii $R_1$ and $R_2$ and the PLD fluctuation effective coefficients $\kappa_1$ and $\kappa_2$. The PLD fluctuation f(t) is obtained from the gt(t).

Next, PLD fluctuation recognition methods are described in which the PLD fluctuation f(t) is calculated from the rotation information gf(t) shown in Equation 8 obtained from the rotation angle velocities $\omega_1$ and $\omega_2$ of the first roller 101 and the second roller 102.

In the present embodiment, three PLD fluctuation recognition methods are described.

[PLD Fluctuation Recognition Method 1]

Figure 3:
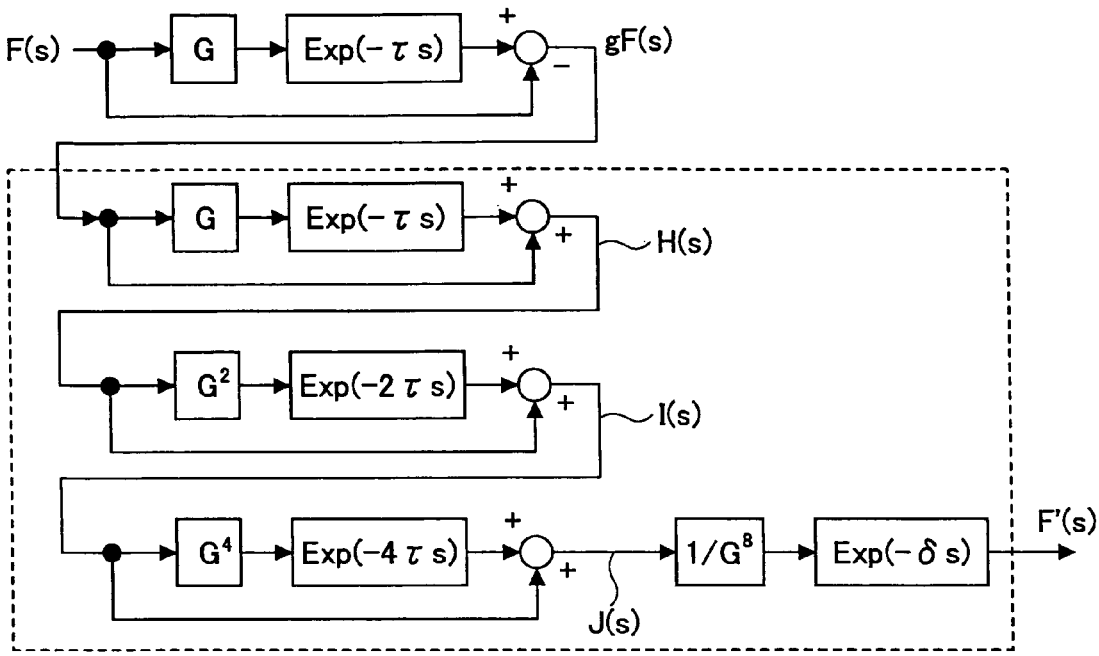
FIG. 3 is a control block diagram for describing a PLD fluctuation recognition method 1 according to the embodiment of the present invention.
Figure 3:
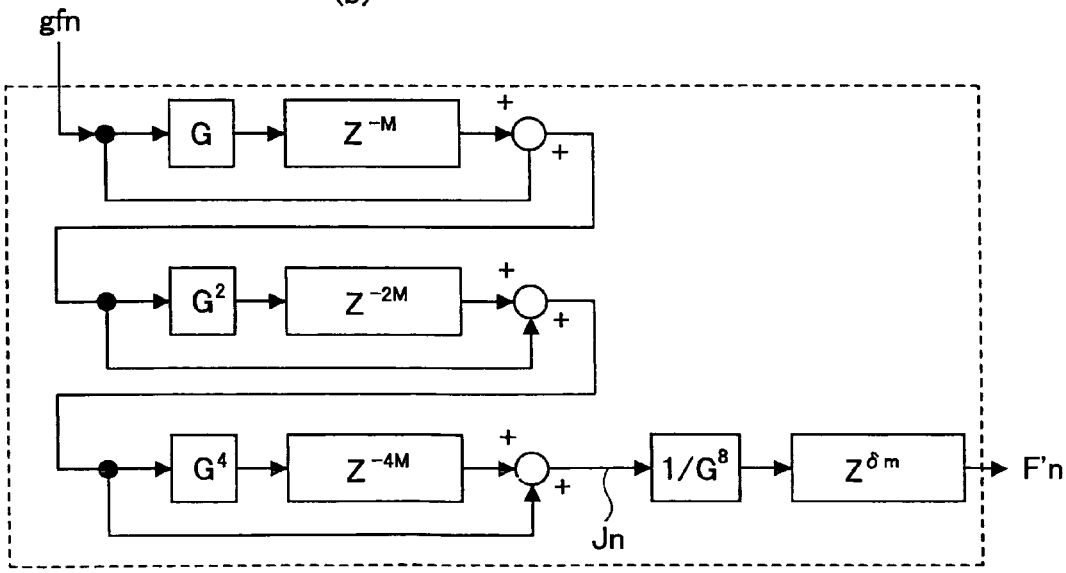

FIG. 3 is a control block diagram for describing a PLD fluctuation recognition method 1. In FIG. 3(*a*), a function F(s), in which Laplace transformation is applied to the time (periodic) function f(t), is used, and "s" is a Laplace operator. That is, F(s)=L {f(t)}; L{x} is the Laplace transformation of "x". Further, in FIG. 3(*a*), the $0^{th}$ step shown at the uppermost position shows Equation 8, and a part surrounded by a dashed line is a filter section in which the first step and steps after the first step are disposed.

When the gF(s), that is, the left side of Equation 7 (data obtained from the detected rotation angle velocities $\omega_1$ and $\omega_2$), is input to the filter section, a time function h(t) of an output H(s) from the first step is shown, that is, $L^{-1}\{H(s)\}$ is shown in Equation 10. Where, $L^{-1}\{y\}$ shows inverse Laplace transformation of "y". Similarly, outputs I(s) and J(s) are obtained.

$$\begin{aligned} h(t) &= [gf(t) + Ggf(t-\tau)] \quad \text{[Equation 10]} \\ &= Gf(t-\tau) - f(t) + G[Gf(t-2\tau) - f(t-\tau)] \\ &= G^2 f(t-2\tau) - f(t) \end{aligned}$$

At this time, G>1 and "$G^2$" is sufficiently greater than "G" ($G \ll G^2$). When the h(t) is compared with the gf(t), in the h(t), the difference of fluctuation amplitudes of the PLD fluctuation f(t) between the first term and the second term is great.

In addition, a time function i(t) of an output I(s) from the second step is shown in Equation 11.

$$\begin{aligned} i(t) &= [h(t) + G^2 h(t-2\tau)] \quad \text{[Equation 11]} \\ &= G^2 f(t-2\tau) - f(t) + \\ &\quad G^2[G^2 f(t-4\tau) - f(t-2\tau)] \\ &= G^4 f(t-4\tau) - f(t) \end{aligned}$$

At this time, "$G^4$" is sufficiently greater than "$G^2$," ($G^2 \ll G^4$). When the i(t) is compared with the h(t), in the i(t), the difference of fluctuation amplitudes of the PLD fluctuation f(t) between the first term and the second term is great.

Further, a time function j(t) of an output J(s) from the third step is shown in Equation 12.

$$\begin{aligned} j(t) &= [i(t) + G^4 i(t-4\tau)] \quad \text{[Equation 12]} \\ &= G^4 f(t-4\tau) - f(t) + \\ &\quad G^4[G^4 f(t-8\tau) - f(t-4\tau)] \\ &= G^8 f(t-8\tau) - f(t) \end{aligned}$$

At this time, "$G^8$" is sufficiently greater than "$G^4$" ($G^4 \ll G^8$). When the j(t) is compared with the i(t), in the j(t), the difference of fluctuation amplitudes of the PLD fluctuation f(t) between the first term and the second term is great. When the j(t) is divided by $G^8$ and adjusted by a phase δ, a PLD fluctuation f'(t) is obtained as shown in Equation 13.

$$\begin{aligned} f'(t) &= \frac{j(t-\delta)}{G^8} \quad \text{[Equation 13]} \\ &= \frac{1}{G^8}[G^8 f(t-8\tau-\delta) - f(t-\delta)] \\ &= f(t-8\tau-\delta) - \frac{1}{G^8} f(t-\delta) \\ &\cong f(t) \end{aligned}$$

Where the phase δ is shown in Equation 14.

$$-8\tau-\delta=-2\pi n_b \quad \text{[Equation 14]}$$

That is, the result of the phase correction by the phase δ corresponds to the belt rotation cycle. Where "$n_b$" is the number of rotations of the belt and is an integer. By the above operations, the PLD fluctuation f(t) can be obtained. An error of this time is shown in the second term of the third row; however, as shown in the second term of the third row in Equation 13, since the second term is divided by $G^8$, the error is very small. Further, when the number of steps is increased, the error can be further small. When f(t−τ) is obtained, in Equation 14, 8τ is changed to 7τ and the phase δ is determined.

By following the sequence below in which the above result is generalized, the PLD fluctuation f(t) can be obtained at high accuracy by using the left side data shown in Equation 7 which data are obtained from the detected rotation angle velocities $\omega_1$ and $\omega_2$.

(First Step)

A value $g_1(t)$ is obtained by adding the gf(t) to data in which the gf(t) is multiplied by G and the multiplied data are delayed by the delay period τ.

(Second Step)

A value $g_2(t)$ is obtained by adding the $g_1(t)$ to data in which the $g_1(t)$ is multiplied by $G^2$ and the multiplied data are delayed by the delay period $2\tau$.

(Third Step)

A value $g_3(t)$ is obtained by adding the $g_2(t)$ to data in which the $g_2(t)$ is multiplied by $G^4$ and the multiplied data are delayed by the delay period $4\tau$.

Similarly, the following steps are continued.

($N^{th}$ Step)

A value $g_n(t)$ is obtained by adding the $g_{n-1}(t)$ to data in which the $g_{n-1}(t)$ is multiplied by the $2^{n-1}$ power of G and the multiplied data are delayed by the delay period $2^{n-1}\times\tau$.

(Final Step)

The value $g_n(t)$ is divided by the $2^n$ power of G and the divided data are delayed by the delay period $\delta=\Pi n_b-2^n\tau$. Then the delayed data are determined to be the PLD fluctuation data (F'(s)).

That is, in the $n^{th}$ step of the filter section shown in FIG. 3(*a*), data are obtained in which the delay element to input data (output data from the previous step) is determined as the delay period $2^{n-1}\times\tau$, and the gain element is determined as the $2^{n-1}$ power of G. The obtained data are added to the input data. The value $g_n(t)$ (output data from the final step) is divided by the $2^n$ power of G and the divided data are delayed by the delay period $\delta=2\Pi n_b-2^n\tau$. Then the delayed data are determined to be the PLD fluctuation data. In this, the larger the number of steps "n" is, the more accurate the recognition of the PLD fluctuation f(t) is.

FIG. 3(*b*) is a control block diagram in which Z transformation is applied to the control block diagram shown in FIG. 3(*a*). In FIG. 3(*b*), the gf(n) is expressed as gfn and the f(n) is expressed as fn.

In FIG. 3(*b*), the sampling time of data which are input to a filter section (FIR filter) is Ts, the delay period $\tau$ is M×Ts (M is an integer), and the time which the belt 103 needs to move one round is Tb=N×Ts (N is an integer). In this case, the number of samplings while the belt 103 moves one round is N. The PLD fluctuation f(t) obtained from the control block diagram shown in FIG. 3(*b*) is composed of a data string of N pieces of the PLD fluctuation value f(n) obtained at each sampling time Ts. The processes at the filter section are digital processes and the digital filter processes are executed by using a DSP (digital signal processor), a μ CPU, and so on.

[PLD Fluctuation Recognition Method 2]

Figure 4:
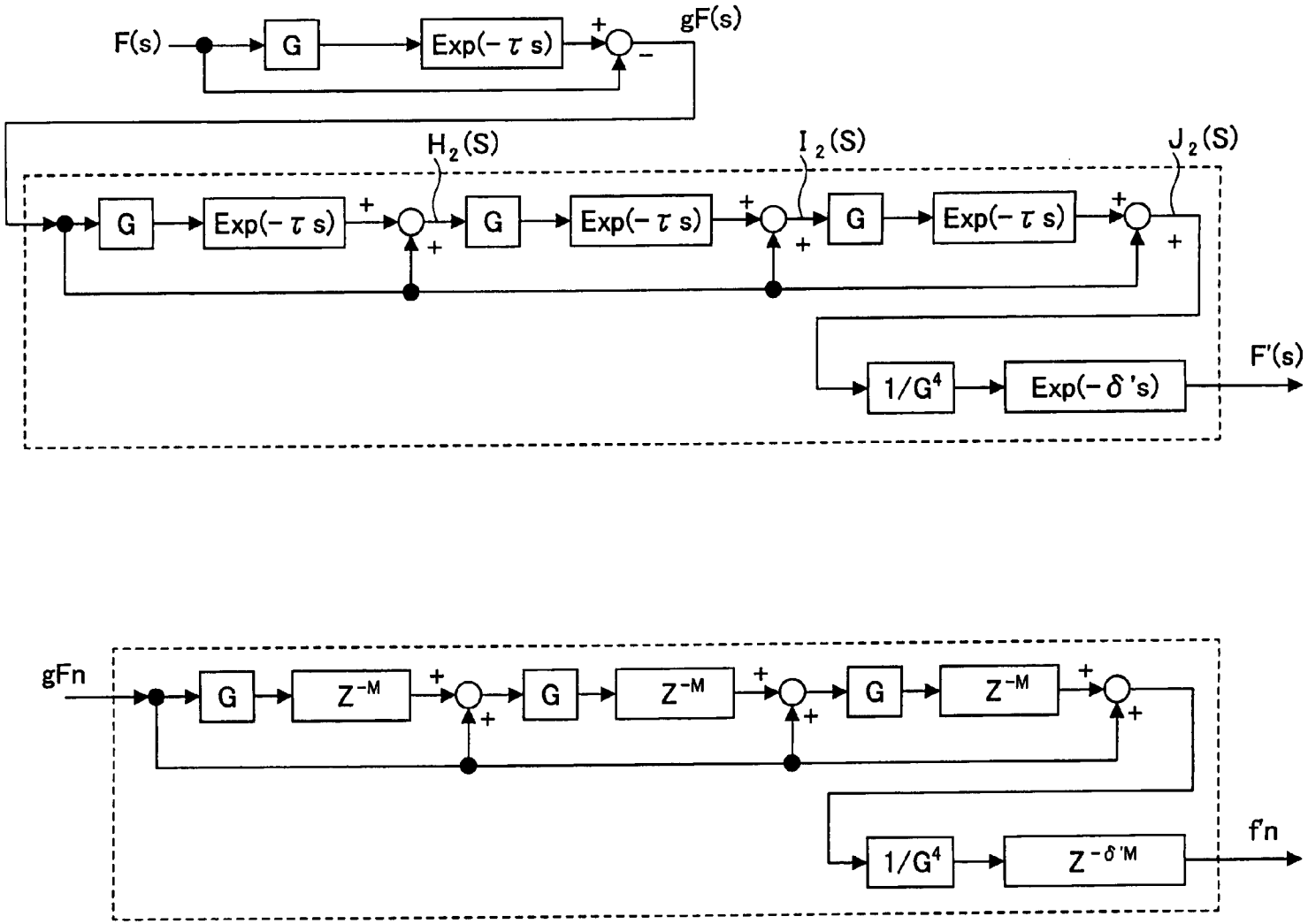
FIG. 4 is a control block diagram for describing a PLD fluctuation recognition method 2 according to the embodiment of the present invention.

FIG. 4 is a control block diagram for describing a PLD fluctuation recognition method 2. In FIG. 4(*a*), similar to that shown in FIG. 3(*a*), a function F(s), in which Laplace transformation is applied to a time function f(t), is used, and "s" is a Laplace operator. Further, in FIG. 4(*a*), the $0^{th}$ step shown at the uppermost position shows Equation 8, and a part surrounded by a dashed line is a filter section in which the first step and steps after the first step are disposed.

When the gF(s), that is, the left side of Equation 7 (data obtained from the detected rotation angle velocities $\omega_1$ and $\omega_2$), is input to the filter section, a time function $h_2(t)$ of an output $H_2(s)$ of the first step is shown in Equation 15.

$$\begin{aligned} h_2(t) &= [gf(t) + Ggf(t-\tau)] \\ &= Gf(t-\tau) - f(t) + G[Gf(t-2\tau) - f(t-\tau)] \\ &= G^2 f(t-2\tau) - f(t) \end{aligned} \quad \text{[Equation 15]}$$

In addition, a time function $i_2(t)$ of an output $I_2(s)$ of the second step is shown in Equation 16.

$$\begin{aligned} i_2(t) &= [gf(t) + Gh_2h(t-\tau)] \\ &= Gf(t-\tau) - f(t) + \\ &\quad G[G^2 f(t-3\tau) - f(t-\tau)] \\ &= G^3 f(t-3\tau) - f(t) \end{aligned} \quad \text{[Equation 16]}$$

Further, a time function $j_2(t)$ of an output $J_2(s)$ of the third step is shown in Equation 17.

$$\begin{aligned} j_2(t) &= [gf(t) + Gi_2(t-\tau)] \\ &= Gf(t-\tau) - f(t) + \\ &\quad G[G^3 f(t-4\tau) - f(t-\tau)] \\ &= G^4 f(t-4\tau) - f(t) \end{aligned} \quad \text{[Equation 17]}$$

At this time, "$G^4$" is sufficiently greater than "G" ($G \ll G^4$). When the $j_2(t)$ is compared with the gf(t), in the $j_2(t)$, the difference of fluctuation amplitudes of the PLD fluctuation f(t) is greater than that of the gf(t) by two times the difference. When the $j_2(t)$ is divided by $G^4$ and adjusted by a phase δ', a PLD fluctuation f'(t) is obtained as shown in Equation 18.

$$\begin{aligned} f'(t) &= \frac{j_2(t-\delta')}{G^4} \\ &= \frac{1}{G^4}[G^4 f(t-4\tau-\delta') - f(t-\delta')] \\ &= f(t-4\tau-\delta') - \frac{1}{G^4} f(t-\delta') \\ &\cong f(t) \end{aligned} \quad \text{[Equation 18]}$$

Where the phase δ' is shown in Equation 19.

$$-4\tau-\delta'=-2\pi n_b \quad \text{[Equation 19]}$$

Similar to the result described in the PLD fluctuation recognition method 1, in the PLD fluctuation recognition method 2, the result of the phase adjustment by the phase δ' corresponds to the belt rotation cycle, where "$n_b$" is the number of rotations of the belt and is an integer. By the above calculations, the PLD fluctuation f(t) can be obtained. An error of this time is shown in the second term of the third row; however, as shown in the second term of the third row, since the second term is divided by $G^4$, the error is very small. When $f(t-\tau)$ is obtained, in Equation 19, $4\tau$ is changed to $3\tau$ and the phase δ' is determined.

By following the sequence below in which the above result is generalized, the PLD fluctuation f(t) can be obtained at high accuracy by using the left side data shown in Equation 7 which data are obtained from the detected rotation angle velocities $\omega_1$ and $\omega_2$.

(First Step)

A value $g_1(t)$ is obtained by adding the gf(t) to data in which the gf(t) is multiplied by G and the multiplied data are delayed by the delay period $\tau$.

(Second Step)

A value $g_2(t)$ is obtained by adding the gf(t) to data in which the $g_1(t)$ is multiplied by G and the multiplied data are delayed by the delay period $\tau$.

(Third Step)

A value $g_3(t)$ is obtained by adding the gf(t) to data in which the $g_2(t)$ is multiplied by G and the multiplied data are delayed by the delay period τ.

Similarly, the following steps are continued.

($N^{th}$ Step)

A value $g_n(t)$ is obtained by adding the gf(t) to data in which the $g_{n-1}(t)$ is multiplied by G and the multiplied data are delayed by the delay period τ.

(Final Step)

The value $g_n(t)$ is divided by the (n+1) power of G and the divided data are delayed by the delay period $\delta'=2\Pi n_b-(n+1)\tau$. Then the delayed data are determined to be the PLD fluctuation data (F'(s)).

In the filter section shown FIG. 4(*a*), the steps executing the same processes from the first step through the $n^{th}$ step are connected in parallel. In each step, data are obtained in which the delay element to input data (output data from the previous step) is determined as the delay period τ, and the gain element is determined as G. The obtained data are added to the input data to the filter section. The value $g_n(t)$ (output data from the final step) is divided by the (n+1) power of G and the divided data are delayed by the delay period $\delta'=2\Pi n_b-(n+1)\tau$. Then the delayed data are determined to be the PLD fluctuation data. In this, the larger the number of steps "n" is, the more accurate the recognition of the PLD fluctuation f(t) is.

In the PLD fluctuation recognition method 2, as described above, the processes in each step are the same. Therefore, when the PLD fluctuation recognition method 2 is installed in a belt driving controller, the circuit structure of the steps is the same. In addition, the step processing program on a DSP is the same. Therefore, designing the circuit and the program can be easy and the number of steps can be easily increased or decreased. That is, optimum circuit structure and program can be designed.

FIG. 4(*b*) is a control block diagram in which Z transformation is applied to the control block diagram shown in FIG. 4(*a*). In FIG. 4(*b*), the gF(s) is expressed as gfn. The processes at the filter section are digital processes and the digital filter processes can be executed by using a DSP, a p CPU, and so on.

[PLD Fluctuation Recognition Method 3]

Figure 5:
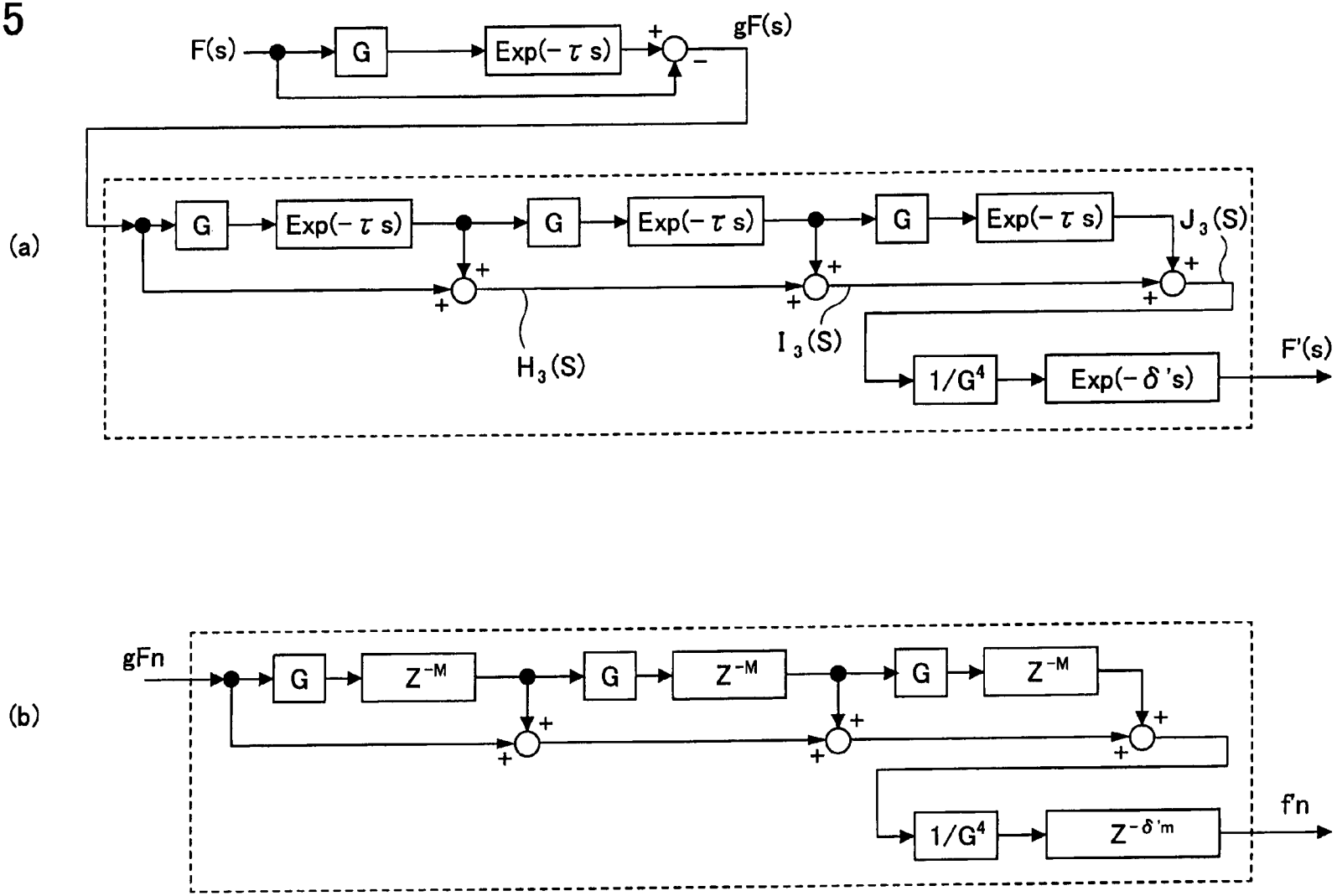
FIG. 5 is a control block diagram for describing a PLD fluctuation recognition method 3 according to the embodiment of the present invention.

FIG. 5 is a control block diagram for describing a PLD fluctuation recognition method 3. In FIG. 5, a part surrounded by a dashed line is a filter section in which the first step and steps after the first step are disposed. The PLD fluctuation recognition method 3 is a modified example of the PLD fluctuation recognition method 2.

In FIG. 5(*a*), when the gF(s), that is, the left side of Equation 7 (data obtained from the detected rotation angle velocities $\omega_1$ and $\omega_2$), is input to the filter section, a time function $h_3(t)$ of an output $H_3(s)$ from the first step, a time function $i_3(t)$ of an output $I_3(s)$ from the second step, and a time function $j_3(t)$ of an output $J_3(s)$ from the third step are shown in Equation 20.

$$h_3(t) = [gf(t) + Ggf(t-\tau)] = G^2 f(t-2\tau) - f(t) \quad \text{[Equation 20]}$$

$$i_3(t) = [h_3(t) + G^2 gf(t-2\tau)] = G^3 f(t-3\tau) - f(t)$$

$$j_3(t) = [i_3(t) + G^3 gf(t-3\tau)] = G^4 f(t-4\tau) - f(t)$$

At this time, "$G^4$", is sufficiently greater than "G" ($G \ll G^4$). When the $j_3(t)$ is compared with the gf(t), in the $j_3(t)$, the difference of fluctuation amplitudes of the PLD fluctuation f(t) is greater than that of the gf(t) by two times the difference. The processes to be applied to the obtained $j_3(t)$ are the same as those in the PLD fluctuation recognition method 2.

By following the sequence below in which the above result (the PLD fluctuation recognition method 3) is generalized, the PLD fluctuation f(t) can be obtained at high accuracy by using the left side data shown in Equation 7 which data are obtained from the detected rotation angle velocities $\omega_1$ and $\omega_2$.

(First Step)

A value $g_1(t)$ is obtained by adding the gf(t) to data in which the gf(t) is multiplied by G and the multiplied data are delayed by the delay period τ.

(Second Step)

A value $g_2(t)$ is obtained by adding the $g_1(t)$ to data in which the $g_1(t)$ is multiplied by G and the multiplied data are further delayed by the delay period τ.

(Third Step)

A value $g_3(t)$ is obtained by adding the $g_2(t)$ to data in which the $g_2(t)$ is multiplied by G and the multiplied data are further delayed by the delay period τ.

Similarly, the following steps are continued.

($N^{th}$ Step)

A value $g_n(t)$ is obtained by adding the $g_{n-1}$ (t) to data in which the $g_{n-1}(t)$ is further multiplied by G and the multiplied data are further delayed by the delay period τ.

(Final Step)

The value $g_n(t)$ is divided by the (n+1) power of G and the divided data are delayed by the delay period $\delta'=2\Pi n_b-(n+1)\tau$. Then the delayed data are determined to be the PLD fluctuation data (F'(s)).

In the filter section shown FIG. 5(*a*), the steps executing the same processes from the first step through the $n^{th}$ step are connected in parallel. In each step, data are obtained in which the delay element to input data (output data from the previous step) is determined as the delay period τ, and the gain element is determined as G. The obtained data are added to the input data to the filter section. The value $g_n(t)$ (output data from the final step) is divided by the (n+1) power of G and the divided data are delayed by the delay period $\delta'=2\Pi n_b-(n+1)\tau$. Then the delayed data are determined to be the PLD fluctuation data. In this, the larger the number of steps "n" is, the more accurate the recognition of the PLD fluctuation f(t) is.

In the PLD fluctuation recognition method 3, as described above, the processes in each step are the same. Therefore, when the PLD fluctuation recognition method 3 is installed in a belt driving controller, the circuit structure of the steps is the same. Therefore, designing the circuit can be easy and the number of steps can be easily increased or decreased.

FIG. 5(*b*) is a control block diagram in which Z transformation is applied to the control block diagram shown in FIG. 5(*a*). In FIG. 5(*b*), the gF(s) is expressed as gfn. The processes at the filter section are digital processes and the digital filter processes can be executed by using a DSP, a μ CPU, and so on.

As described above, the rotation angle velocity $\omega_1$ of the first roller 101 and the rotation angle velocity $\omega_2$ of the second roller 102 are influenced by the respective PLD fluctuation f(t) and PLD fluctuation f(t−τ) whose phases are different. However, the roller effective radii R and/or the PLD fluctuation effective coefficients κ of the corresponding first and second rollers 101 and 102 are different from each other; therefore, a ratio in which the PLD fluctuation component occupies in the roller effective radius R is different between the first and second rollers 101 and 102. Consequently, the sizes of the rotation angle velocity fluctuations to be detected are different from each other caused by the PLD fluctuations. The inventor of the present invention found a method in which the PLD fluctuation f(t) can be obtained at high accuracy independent of the frequency characteristics by using an algorithm equivalent to a filter such as the FIR filter.

In the PLD fluctuation recognition methods 1 through 3, a recognition error of the PLD fluctuation occurs. Since the size of the recognition error greatly depends on the number of steps "n", the number of steps "n" is determined by the error tolerance of the belt velocity fluctuation.

The error tolerance of the belt velocity fluctuation is determined by the flowing guidance. Generally, the belt moving velocity fluctuation is caused not only by the PLD fluctuation but also eccentricity and accumulated pitch errors of gears in the driving force transmission route. Consequently, the tolerance of the belt moving velocity fluctuation caused by the PLD fluctuation is a tolerance of the pLD fluctuation in designing.

In the driving control of the intermediate transfer belt 10 of the copying machine in the present embodiment, as described above, the color registration errors and the banding, occur caused by the belt moving velocity fluctuation. When an actual belt moving position shifts from a target belt moving position, the belt moving velocity fluctuation occurs. When the shifting amount of the belt moving position becomes large, the belt moving velocity fluctuation becomes large. The color registration errors and the banding of the image on the recording medium are noticed by a user.

For example, in the case of the banding, the tolerance of an actual unnoticeable level can be defined as a spatial frequency "fs" which shows a changing interval (distance) of the image density. The spatial frequency "fs" has a relationship with a time frequency "f"; f=F×fs (F is a constant). Therefore, the tolerance of the shift amount of the belt moving position can be defined so that the tolerance of the banding is within a predetermined tolerance of the special frequency "fs". Consequently, the tolerance of the belt moving velocity fluctuation can be defined. The above defined tolerance is called a predetermined tolerance.

Next, specific belt driving control for restraining the belt moving velocity fluctuation caused by the PLD fluctuation is described by using the PLD fluctuation f(t) obtained by the PLD fluctuation recognition methods 1 through 3.

As the specific belt driving control by using the PLD fluctuation f(t), plural control methods are possible corresponding to the device structures. In this, two control methods are described. That is, a control method (belt driving control example 1) is described in a device in which a mechanism for detecting the home position of the belt 103 is provided, and another control method (belt driving control example 2) is described in a device in which the mechanism for detecting the home position of the belt 103 is not provided.

Belt Driving Control Example 1

When suitable belt driving control corresponding to the PLD fluctuation is executed by using the PLD fluctuation f(t), a phase (when the belt one round is 2Π) of the PLD fluctuation on the belt 103 must be obtained. As the phase obtaining method, a home position mark of the belt 103 is determined beforehand and the mark is detected. Then, the phase is obtained by using any one of time information measured by a timer, driving motor rotation angle information, and rotation angle information by an output from a rotary encoder.

Figure 6:
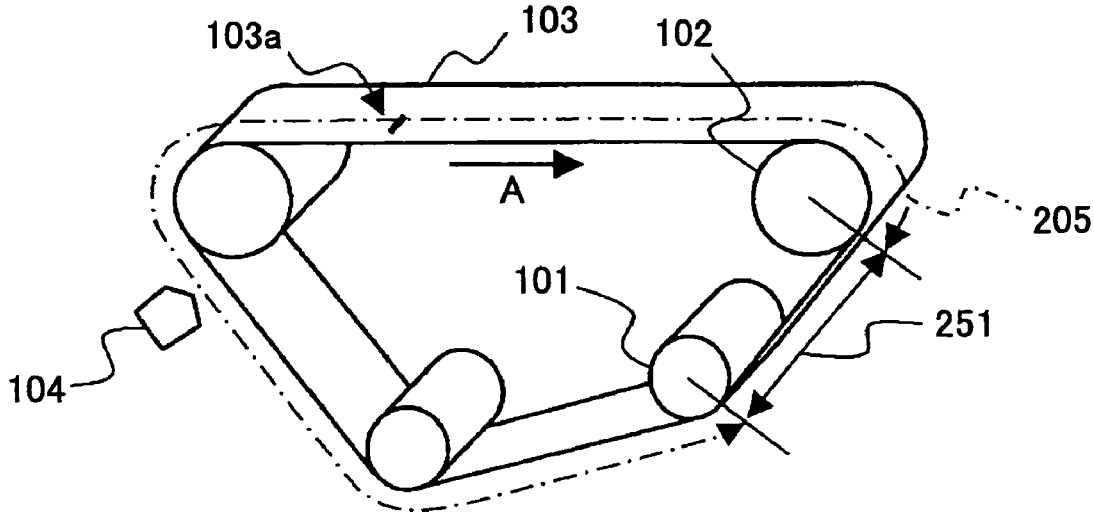
FIG. 6 is a schematic diagram showing a structure which detects a home position mark of a belt according to the embodiment of the present invention.

FIG. 6 is a schematic diagram showing a structure which detects a home position mark of the belt 103 according to the embodiment of the present invention. A home position mark 103*a* is formed on the belt 103 and the home position mark 103*a* is detected by a mark detecting sensor (mark detecting unit) 104, and a phase which becomes a reference in belt one round is obtained.

In the present example, as the home position mark 103*a*, a metal film which is adhered at a predetermined position on the belt 103 is used, and as the mark detecting sensor 104, a reflection type photosensor disposed on a fixed member (not shown) is used. The mark detecting sensor 104 outputs a pulse when the home position mark 103*a* passes through a detection region of the mark detecting sensor 104. The position where the home position mark 103*a* is disposed is at an end part in the width direction on the inner circumference surface or the outer circumference surface of the belt 103 so that the home position mark 103*a* dose not affect a process forming an image. Image forming materials such as ink and toner may be attached onto the home position mark 103*a* and a sensor surface of the mark detecting sensor 104. In this case, there is a risk that another position will be recognized as the home position by mistake. In order to avoid such wrong recognition, it is desirable that a function of recognizing an accurate belt home position be added to the mark detecting sensor 104 while managing sensor output amplitude, a pulse width, and a pulse interval. In this, at least one home position mark is needed; however, plural marks can be provided by patterning so as to avoid the wrong recognition.

Figure 7:
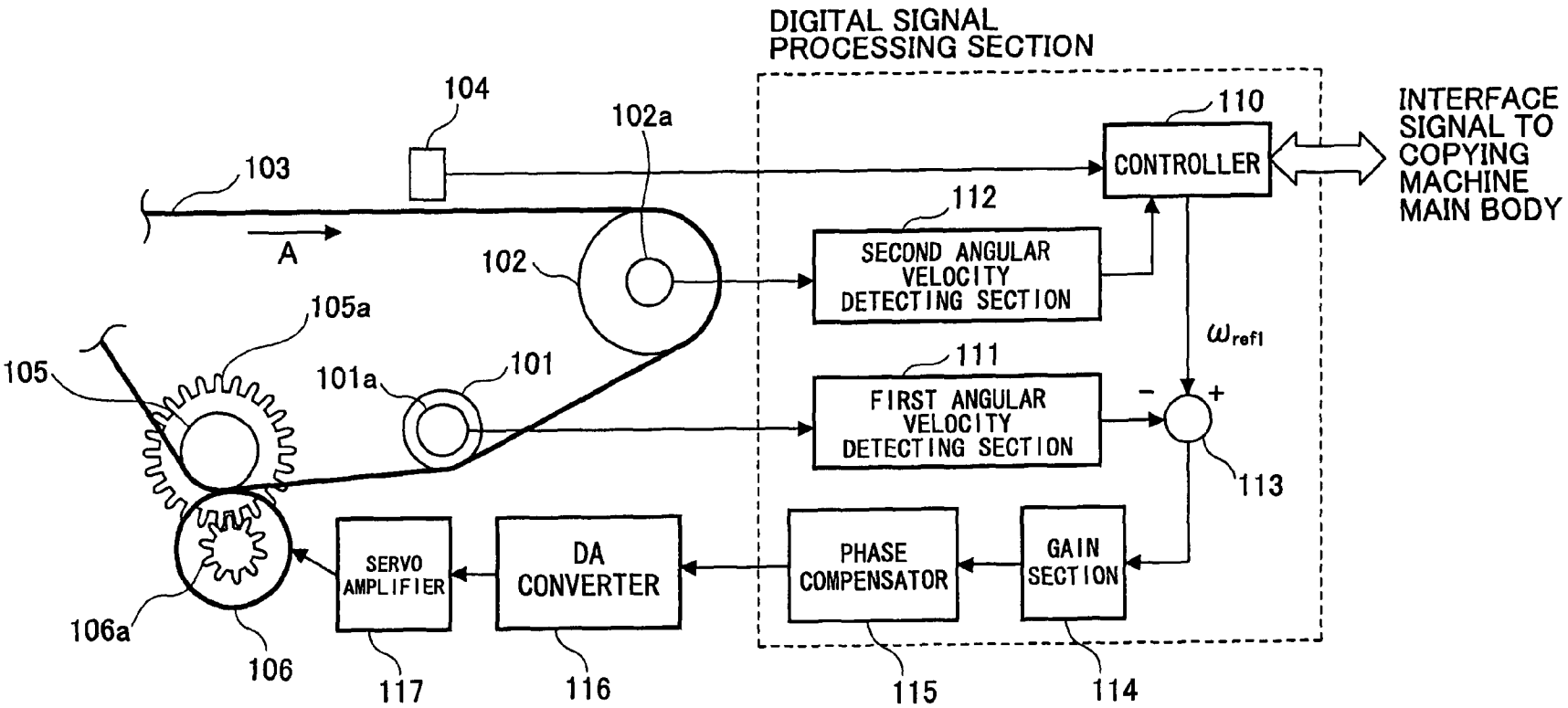
FIG. 7 is a diagram for describing control operations in a belt driving control example 1 using a disposing position example 1 of rotary encoders according to the embodiment of the present invention.

FIG. 7 is a diagram for describing control operations in the belt driving control example 1. In FIG. 7, the position of the mark detecting sensor 104 is different from that shown in FIG. 6 for the sake of convenience of the description.

A rotation driving force generated by a driving motor 106 (driving source) is transmitted to a driving roller 105 via a deceleration mechanism composed of a driving gear 106*a* and a driven gear 105*a*. With this, the driving roller 105 is rotated and the belt 103 is moved in the arrow A direction. The first roller 101 and the second roller 102 are rotated together by the movement of the belt 103. A first rotary encoder 101*a* is disposed in the first roller 101 and a second rotary encoder 102*a* is disposed in the second roller 102; a signal output from the first rotary encoder 101*a* is input to a first angular velocity detecting section 111 (detecting unit) and a signal output from the second rotary encoder 102*a* is input to a second angular velocity detecting section 112 (detecting unit) in the digital signal processing section. The rotary encoders 101*a* and 102*a* can be connected to the corresponding rollers 101 and 102 via a deceleration mechanism composed of, for example, gears (not shown). In order to avoid sliding contact with the inner circumference surface of the belt 103, surface treatment is applied to the surfaces of the first roller 101 and the second roller 102, and further, belt winding angles for the belt 103 are selected. In the present example, the diameter of the second roller 102 is larger than that of the first roller 101. A motor control signal calculated in the digital signal processing section is input to a servo amplifier 117 via a DA converter 116. The servo amplifier 117 drives the driving motor 106 based on the motor control signal.

In the digital signal processing section, the first angular velocity detecting section 111 detects the rotation angle velocity $\omega_1$ of the first roller 101 from a signal output from the first rotary encoder 101*a*. Similarly, the second angular velocity detecting section 112 detects the rotation angle velocity $\omega_2$ of the second roller 102 from a signal output from the second rotary encoder 102*a*.

A controller 110 calculates a control target (reference) value $\omega_{ref1}$ corresponding to PLD fluctuation data of the belt 103 based on a target belt velocity instruction from the copying machine. Specifically, first, the belt 103 is driven so that the rotation angle velocity $\omega_1$ of the first roller 101 is maintained at the control target value $\omega_{ref1}$ based on the target belt velocity instruction from the copying machine. That is, the belt 103 is driven so that the rotation angle velocity $\omega_1$ of the first roller 101 becomes constant. Therefore, at this time, the control target value $\omega_{ref1}$ becomes constant rotation angle velocity $\omega_{01}$ described above. When the rotation angle velocity $\omega_1$ of the first roller 101 becomes constant, by making a pulse signal from the mark detecting sensor 104 a reference, in any one of the PLD fluctuation recognition methods 1 through 3, data of the PLD fluctuation f(t) are obtained from the rotation angle velocity $\omega_2$ of the second roller 102. Then, the control target value $\omega_{ref1}$ suitable corresponding to the data of the PLD fluctuation f(t) is calculated and output.

The control target value $\omega_{ref1}$ output from the controller 110 is compared with the rotation angle velocity $\omega_1$ of the first roller 101 at a comparator 113, and a deviation which is the compared result is output from the comparator 113. The deviation is input to a phase compensator 115 via a gain section 114 and a motor control signal is output from the phase compensator 115. The deviation which is input to the gain section 114 is a value between the control target value $\omega_{ref1}$ in which the PLD fluctuation of the belt 103 is corrected and the rotation angle velocity $\omega_1$ of the first roller 101. The deviation is generated by sliding contact between the driving roller 105 and the belt 103, driving force transmission errors caused by eccentricity of the driving gear 106*a* and the driven gear 105*a*, a belt moving velocity fluctuation caused by eccentricity of the driving roller 105, and so on. The motor control signal makes the deviation small and drives the driving motor 106 so that the belt 103 moves at a constant velocity. In order to realize this, an adjusted motor control signal is output by using, for example, a PID controller (not shown) so that the deviation from the target velocity is decreased and stabilization is obtained without overshooting and without oscillating by the belt 103.

In order to maintain the belt moving velocity V at a constant velocity $V_0$, the rotation angle velocity $\omega_1$ of the first roller 101 is controlled to satisfy Equation 21. In this, when the rotation angle velocity $\omega_2$ of the second roller 102 is controlled, it is controlled to satisfy Equation 22.

$$V_0 = \{R_1 + \kappa_1 f(t-\tau)\}\omega_1 \quad \text{[Equation 21]}$$

$$\omega_1 = \frac{V_0}{\{R_1 + \kappa_1 f(t-\tau)\}} \cong \frac{V_0}{R_1}\left\{1 - \frac{\kappa_1}{R_1} f(t-\tau)\right\} = \omega_{ref1}$$

$$\omega_2 \cong \frac{V_0}{R_2}\left\{1 - \frac{\kappa_2}{R_2} f(t)\right\} = \omega_{ref2} \quad \text{{Equation 22]}}$$

In the belt driving control example 1, even if the PLD fluctuation in the belt circumference direction exists in the belt 103, as described above, the rotation angle velocity $\omega_1$ of the first roller 101 is controlled to become the control target value $\omega_{ref1}$ which is corrected by the PLD fluctuation f(t−τ). Therefore, the fluctuation of the belt moving velocity caused by the PLD fluctuation can be restrained.

Belt Driving Control Example 2

In the belt driving control example 1, the structure which detects the home position mark 103*a* is used. However, in order to reduce cost, in the belt driving control example 2, the above structure is not used.

The basic processes in the belt driving control example 2 are the same as those in the belt driving control example 1. However, the home position of the belt 103 is obtained by using a virtual home position signal which virtually specifies the home position of the belt 103, instead of using the pulse signal of the mark detecting sensor 104 in the belt driving control example 1 show in FIG. 7. For example, it is predicted that the belt 103 moves around from an arbitrary position, by using accumulated rotation angles of the rollers obtained from the first and second rotary encoders 101*a* and 102*a*, as the virtual home position signal. In this case, since the accumulated rotation angles of the rollers while the belt 103 moves around can be obtained beforehand, it is possible to predict that the belt 103 moves around from the accumulated rotation angles. At this time, the count starting time of the accumulated rotation angles is t=0 in the PLD fluctuation f(t). The count starting time corresponds to a receiving time of the pulse signal from the mark detecting sensor 104 in the belt driving control example 1.

The virtual home position signal is set to be generated every rotation cycle of the belt 103. In addition to the use of the accumulated rotation angles, various methods can be used as the method setting the generation of the virtual home position signal. For example, it is predicted that the belt 103 moves around from an arbitrary position by using an accumulated rotation angle of the driving motor 106, and when the accumulated rotation angle reaches an angle corresponding to the belt one round, the virtual home position signal is generated. In addition, when the belt 103 moves at a predetermined average moving velocity, a time which the belt 103 needs to move around is predicted from the average moving velocity, and when the time reaches a time in which the belt 103 moves around, the virtual home position signal is generated.

In the belt driving control example 2, in the prediction in which the belt 103 moves around, a difference from an actual movement occurs, caused by the $PLD_{ave}$ which is an average of PLDs of the belt, an accuracy difference among the roller diameters, a change of environment, a change with the passage of time, and so on.

When the difference exists between the belt one round by the prediction of the virtual home position signal and the actual belt one round, the phase of the PLD fluctuation f(t) is shifted in accumulation. Therefore, when the belt driving control is executed by the data of the PLD fluctuation f(t), the belt moving velocity fluctuation becomes great.

The above is described in detail. Even in a case where the PLD fluctuation f(t) is obtained based on the virtual home position signal, when the target rotation angle velocity of the first roller 101 is controlled by the control target value $\omega_{ref1}$ shown in Equation 21, the rotation angle velocity $\omega_2$ which is detected at the second roller 102 must be the $\omega_{ref2}$ shown in Equation 22. In this, when the virtual home position obtained from the virtual home position signal is shifted by a time "d" from the actual home position, the belt moving velocity $V_d$ at this time is shown in Equation 23.

$$V_d = \{R_1 + \kappa_1 f(t-\tau-d)\}\omega_{ref1} \quad \text{[Equation 23]86}$$

When Equation 21 is substituted for Equation 23, Equation 24 is obtained.

$$V_d \cong V_0\left\{1 + \frac{\kappa_1}{R_1}(f(t-\tau-d) - f(t-\tau))\right\} \quad \text{[Equation 24]}$$

The rotation angle velocity $\omega_{2d}$ of the second roller 102 at this time is shown in Equation 25.

$$\omega_{2d} = \frac{V_d}{\{R_2 + \kappa_2 f(t-d)\}} \quad \text{[Equation 25]}$$

Further, when Equation 22 is substituted for Equation 25 and modified, Equation 26 is obtained.

$$\omega_{2d} \cong \frac{V_0}{R_2}\left\{\begin{array}{c} 1 - \frac{\kappa_2}{R_2} f(t-d) + \\ \frac{\kappa_1}{R_1}(f(t-\tau-d) - f(t-\tau)) \end{array}\right\} \quad \text{[Equation 26]}$$

Therefore, the shift amount $\omega_{2\delta}$ of the rotation angle velocity of the second roller 102, caused by the virtual home position obtained from the virtual home position signal being shifted by the time "d" from the actual home position, is shown in Equation 27. That is, the shift amount $\omega_{2\delta}$ of the rotation angle velocity of the second roller 102 can be obtained as a difference between the rotation angle velocity detection data $\omega_{2d}$ of the second roller 102 and the reference data $\omega_{ref2}$ of the second roller 102.

$$\omega_{2\delta} = \omega_{2d} - \omega_{ref2} \quad \text{[Equation 27]}$$

When Equation 22 and Equation 26 are substituted for Equation 27 and modified, Equation 28 can be obtained.

$$\omega_{2\delta} = \frac{V_0}{R_2}\left[\begin{array}{c} \frac{\kappa_1}{R_1}\{f(t-\tau-d) - f(t-\tau)\} - \\ \frac{\kappa_2}{R_2}\{f(t-d) - f(t)\} \end{array}\right] \quad \text{[Equation 28]}$$

In Equation 28, the shift amount $\omega_{2\delta}$ is a result of the addition (subtraction) of the fluctuation component (first term) generated so that the virtual home position is shifted from the actual home position by the time "d" in the first roller 101 and the fluctuation component (second term) generated so that the virtual home position is shifted from the actual home position by the time "d" in the second roller 102.

When the absolute value of the shift amount $\omega_{2\delta}$ exceeds a predetermined value, or an average value, a mean-square value, or a root-mean-square value of the absolute values of the shift amounts $\omega_{2\delta}$ in one round of the belt exceeds a predetermined value, the currently recognized PLD fluctuation f(t) is corrected. In the correction, the rotation angle velocity $\omega_2$ of the second roller 102 is detected while controlling the rotation angle velocity $\omega_1$ of the first roller 101 to be a constant rotation angle velocity $\omega_{01}$, and with this, a new PLD fluctuation f(t) is obtained. After this, the rotation angle velocity $\omega_1$ of the first roller 101 is controlled to become the reference rotation angle velocity $\omega_{ref1}$ by using the data of the new PLD fluctuation f(t).

[Renewal of PLD Fluctuation]

Next, processes in which an obtained PLD fluctuation f(t) is renewed are described.

In some cases, the belt thickness is changed by a change in environment (temperature and humidity) or wearing in long-time usage, and the Young's modulus of the belt is changed in repetition of bending and stretching, depending on the belt material. With this, the PLD of the belt 103 is changed with the passage of time and the PLD fluctuation of the belt 103 is also changed. In addition, in some cases, when the belt 103 is changed, the new PLD fluctuation is changed from the previous PLD fluctuation. Further, as described in the belt driving control example 2, the virtual home position may be shifted from the actual home position. In these cases, the PLD fluctuation f(t) must be renewed.

As the renewal method of the PLD fluctuation f(t), two method are mainly assumed. That is, in a first method, the PLD fluctuation f(t) is intermittently renewed, and in a second method, the PLD fluctuation f(t) is continuously renewed. In the first method, it is monitored whether belt driving control by the PLD fluctuation f(t) is properly executed, and when it is determined that the belt driving control is not being executed properly, the PLD fluctuation f(t) is renewed. In the second method, the PLD fluctuation f(t) is always obtained and the PLD fluctuation f(t) is continuously renewed. In addition, there a method in which the PLD fluctuation f(t) is renewed periodically without monitoring the belt driving control.

First, the principle in which the obtained PLD fluctuation f(t) is renewed is described.

When the PLD fluctuation f(t) is once obtained accurately, the rotation angle velocity $\omega_1$ of the first roller 101 is maintained at $\omega_{ref1}$ shown in Equation 21. When the PLD fluctuation f(t) is changed to a PLD fluctuation g(t), the change (shift amount) $\Delta\omega_{2\epsilon}$ of the rotation angle velocity of the second roller 102 becomes a value shown in Equation 29.

$$\Delta\omega_{2\varepsilon} = \frac{V_0}{R_2}\left[\begin{array}{c} \frac{\kappa_1}{R_1}\{g(t-\tau) - f(t-\tau)\} - \\ \frac{\kappa_2}{R_2}\{g(t) - f(t)\} \end{array}\right] \quad \text{[Equation 29]}$$

Similar to Equation 28, in Equation 29, the change $\Delta\omega_{2\epsilon}$, is a result of the addition (subtraction) of the fluctuation component (first term) generated so that the PLD fluctuation f(t) is changed to the PLD fluctuation g(t) in the first roller 101 and the fluctuation component (second term) generated so that the PLD fluctuation f(t) is changed to the PLD fluctuation g(t) in the second roller 102. Therefore, the renewal method when the PLD fluctuation f(t) is changed to the PLD fluctuation g(t) can also correct the errors caused by the shift of the virtual home position described in the belt driving control example 2.

When Equation 29 is modified by using Equation 30 shown below, Equation 31 is obtained. "G" in Equation 31 is the same as that in Equation 9.

$$\varepsilon(t) = g(t) - f(t) \quad \text{[Equation 30]}$$

$$\Delta\omega_{2\varepsilon} = \frac{V_0\kappa_2}{R_2^2}[G\varepsilon(t-\tau) - \varepsilon(t)] \quad \text{[Equation 31]}$$

Where $\epsilon(t)$ can be obtained by using the filtering process in the PLD fluctuation recognition method 1, 2, or 3 based on the shift amount $\Delta\omega_{2\epsilon}$. When the $\epsilon(t)$ is obtained, a new PLD fluctuation f'(t) is obtained by adding the $\epsilon(t)$ to the old PLD fluctuation f(t). As shown in Equation 32, the new PLD fluctuation f'(t) is the same as the changed PLD fluctuation g(t).

$$f'(t)=f(t)+\epsilon(t)=f(t)+g(t)-f(t)=g(t) \quad \text{[Equation 32]}$$

Therefore, when the belt driving control is executed by using the new PLD fluctuation f'(t) instead of using the old PLD fluctuation f(t), proper belt driving control corresponding to the changed PLD fluctuation g(t) can be executed.

In the above description, the $\epsilon(t)$ is obtained from the $\Delta\omega_{2\epsilon}$ and the PLD fluctuation f(t) is changed to the PLD fluctuation g(t) by using the $\epsilon(t)$. However, a method can be used in which the PLD fluctuation g(t) is directly obtained, and the new PLD fluctuation f'(t) is obtained.

Next, disposing positions of the rotary encoders which detect the rotation angle velocities $\omega_1$ and $\omega_2$ of the corresponding first and second rollers 101 and 102 are described. The rotary encoders are necessary elements for executing the belt driving control.

In the belt driving control, when the rotation angle velocities of two rollers whose diameters are different from each other are detected, the belt moving velocity fluctuation caused by the PLD fluctuation of the belt 103 can be restrained. In this, strictly, that the diameters of the two rollers are different is signified as follows: in the relationship between the two rollers, "G" in Equation 9 is not 1 (G is greater than 1).

As the disposing positions of the rotary encoders which detect the corresponding rotation angle velocities, for example, the following three disposing positions can be assumed. In a disposing position example 1 of the rotary encoders, as shown in FIG. 7, the rotary encoders are disposed in corresponding two driven rollers whose diameters are different from each other. In a disposing position example 2 of the rotary encoders, the rotary encoders are disposed in the driving roller 105 and a driven roller whose diameter is different from that of the driving roller 105. In a disposing position example 3 of the rotary encoders, the rotary encoders are disposed in the driving roller 105 and two driven rollers whose diameters are different from each other, or the rotary encoders are disposed in the driving roller 105 and two driven rollers whose diameters are different from that of the driving roller 105. In this, when the rotary encoder is disposed in the driving roller 105, two cases are included, that is, in one case, the rotary encoder is disposed at the roller axle of the driving roller 105; in the other case, the rotary encoder is disposed at the motor axle of the driving motor 106.

Disposing Position Example 1 of Rotary Encoders

In the disposing position example 1, as shown in FIG. 7, the rotary encoders are disposed in the corresponding driven rollers 101 and 102 whose diameters are different from each other. In this case, a feedback control function is provided in the driving motor 106 (driving source) so that the rotation angle velocity $\omega_1$ of the first roller 101 becomes the control target value $\omega_{ref1}$ which is determined by the controller 110. Therefore, the PLD fluctuation f(t) can be accurately obtained in conditions in which transmission errors in the driving force transmission route and sliding contact between the driving roller 105 and the belt 103 are corrected. For example, in the conditions in which the driving roller 105 is controlled in feedback, the PLD fluctuation f(t) is obtained from the detected result of the rotation angle velocity $\omega_2$ of the second roller 102; with this, the highly accurate PLD fluctuation f(t) can be obtained without the transmission errors in the driving force transmission route and the sliding contact between the driving roller 105 and the belt 103.

Disposing Position Example 2 of Rotary Encoders

Figure 8:
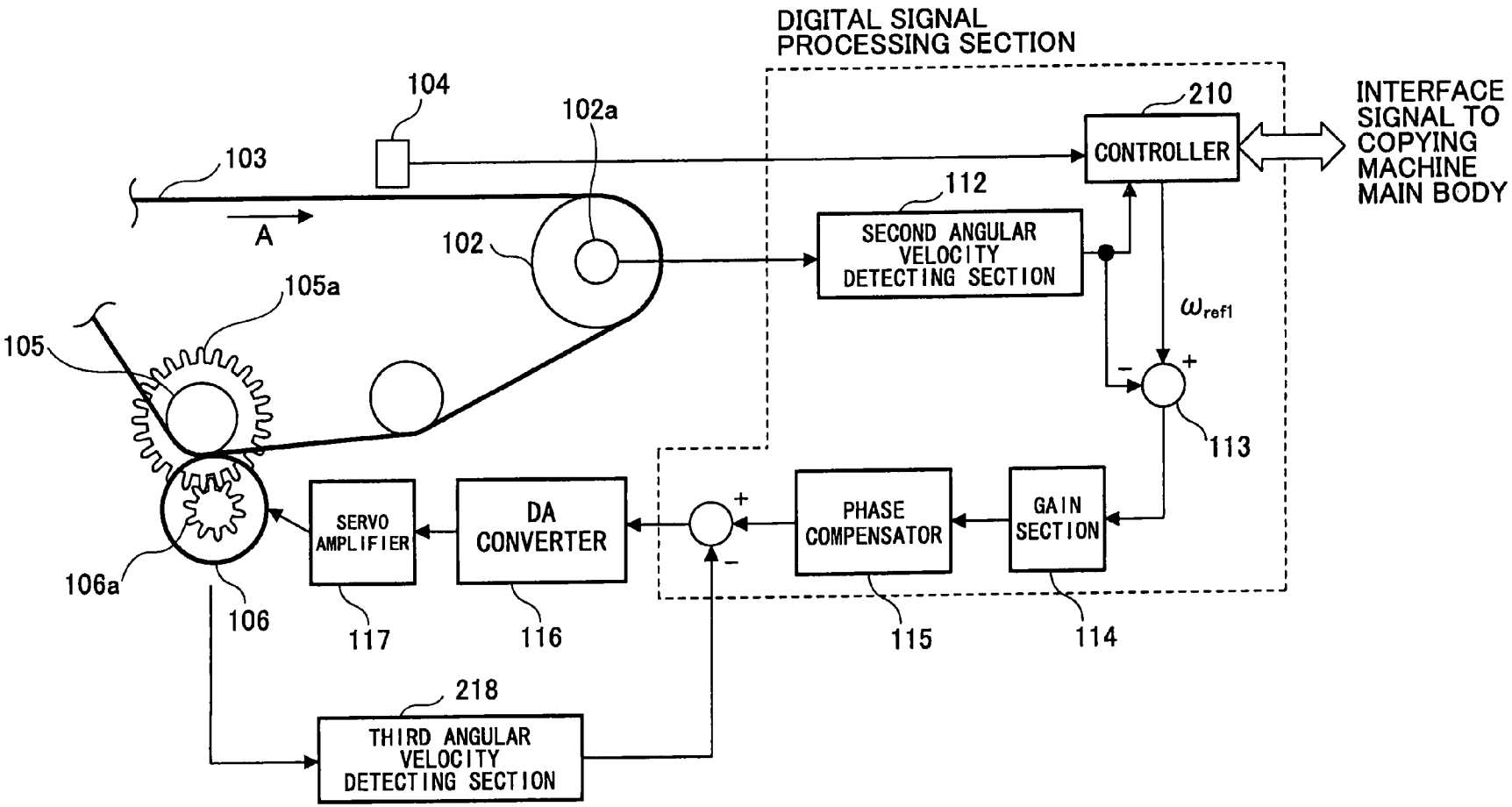
FIG. 8 is a diagram for describing control operations in a disposing position example 2 of rotary encoders according to the embodiment of the present invention.

FIG. 8 is a diagram for describing control operations in the disposing position example 2 of the rotary encoders. As shown in FIG. 8, in the disposing position example 2, the driving motor 106 is connected to the driving roller 105 via the gears 106*a* and 105*a*. As the driving motor 106, a DC servo motor is used and a rotation angle velocity is detected by attaching a rotary encoder (not shown) to the motor axle or the driving roller axle for feedback control. A stepping motor which can control the rotation angle velocity by using an input driving pulse frequency can be used instead of using the DC servo motor. In this case, the rotation angle velocity can be controlled by the input driving pulse frequency to the stepping motor without the feedback by the rotary encoder; therefore, the rotary encoder is not needed at the motor axle or the driving roller axle. Consequently, in the disposing position example 2, a rotation angle velocity $\omega_m$ of the driving roller 105 and the rotation angle velocity $\omega_2$ of the driven roller (second roller) 102 can be detected. When the main part of the structure shown in 8 is compared with that shown in FIG. 7, in FIG. 8, a third angular velocity detecting section 218 (detecting unit) for detecting the rotation angle velocity $\omega_m$ is newly disposed, and the first angular velocity detecting section 111 is not disposed. In addition, the rotation angle velocity $\omega_m$ of the driving motor 106 of the driving roller 105 and the rotation angle velocity of the driving motor axle have a constant relationship.

Therefore, the rotation angle velocity $\omega_m$ of the driving roller 105 (motor axle) corresponds to the rotation angle velocity $\omega_1$ of the first roller 101 in the disposing position example 1. However, when a velocity reduction mechanism is provided, the rotation angle velocity $\omega_1$ must be obtained by considering the reduction ratio. Consequently, similar to the disposing position example 1, in the disposing position example 2, the PLD fluctuation f(t) can be obtained at high accuracy. However, in the disposing position example 2, in the rotation angle velocity $\omega_2$ of the second roller 102 which is detected at the second angular velocity detecting section 112, fluctuations caused by errors in the driving force transmission route and the sliding contact between the driving roller 105 and the belt 103 are included. Therefore, the PLD fluctuation f(t) must be obtained by removing the above fluctuations. Especially, in order not to slide the driving roller 105 on the belt 103, a friction coefficient must be increased by making the surface of the driving roller 105 rough. In the disposing position example 2, when the stepping motor is used as the driving motor 106, since the rotary encoder is not needed in the driving roller 105, the number of components is reduced and the cost can be reduced.

Disposing Position Example 3 of Rotary Encoders

Figure 9:
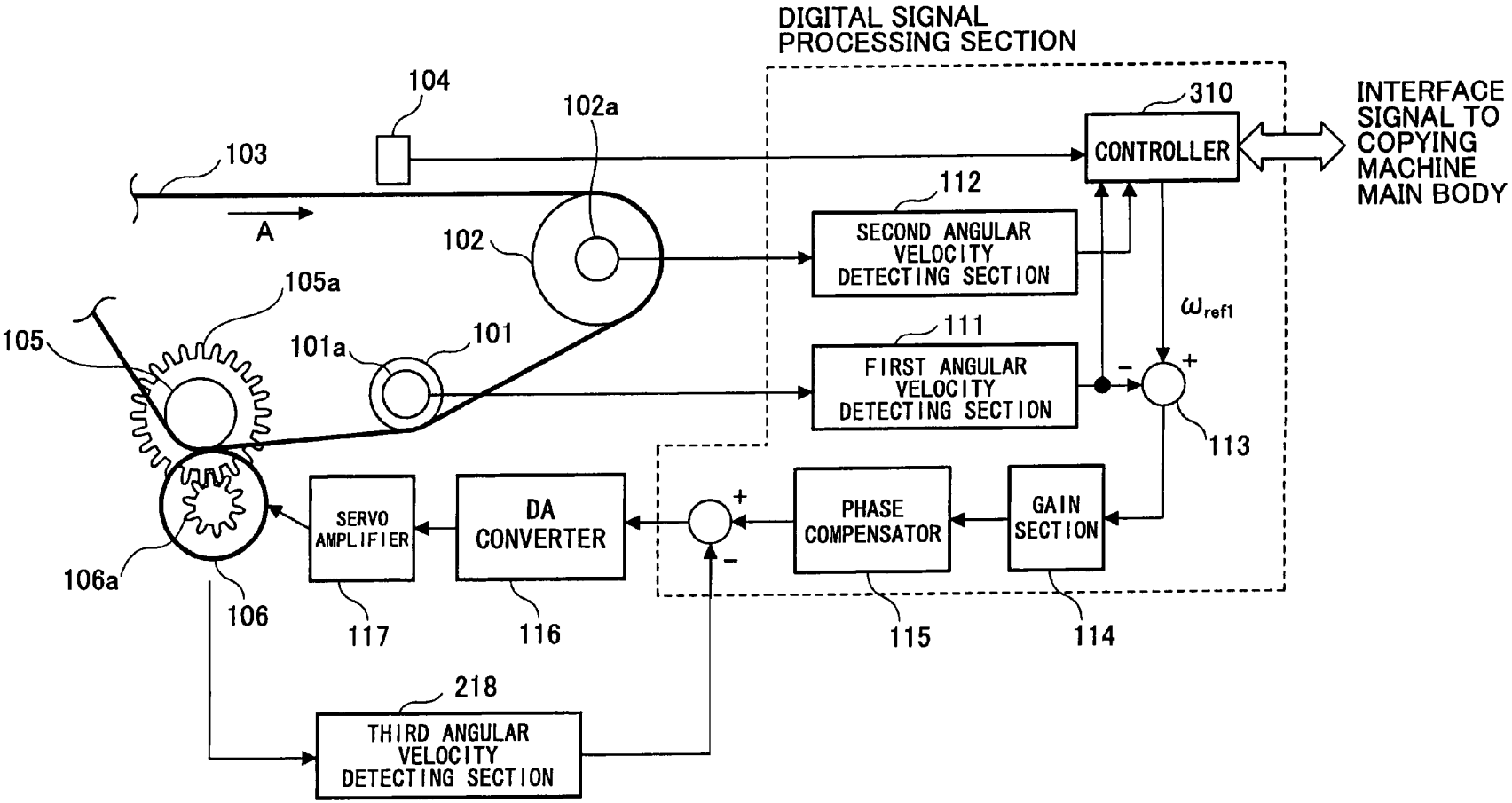
FIG. 9 is a diagram for describing control operations in a disposing position example 3 of rotary encoders according to the embodiment of the present invention.

FIG. 9 is a diagram for describing control operations in the disposing position example 3 of the rotary encoders. Similar to the disposing position example 2, in the disposing position 3, as the driving motor 106, a servo motor or a stepping motor which can control the rotation angle velocity is used. In addition, in the disposing position example 3, similar to the disposing position example 1, the rotary encoders 101*a* and 102*a* are disposed in the corresponding driven rollers 101 and 102 whose diameters are different from each other, respectively. Therefore, similar to the disposing position example 1, in the disposing position example 3, the PLD fluctuation f(t) can be obtained at high accuracy. In addition, in the disposing position example 3, a minor loop structure is used, in which the rotation angle velocity $\omega_m$ of the driving motor axle is obtained; that is, as shown in FIG. 9, similar to the disposing position example 2, the third angular velocity detecting section 218 which detects the rotation angle velocity $\omega_m$ is disposed. Therefore, a more stable control system can be realized.

In addition, the driving motor axle is rotated at a constant rotation angle velocity; that is, the driving roller 105 is driven at a constant rotation angle velocity, and the average rotation angle velocities of the first roller 101 and the second roller 102 are obtained. With this, the diameter ratio between the first roller 101 and the second roller 102 can be obtained at high accuracy. Consequently, even if the roller effective radii $R_1$ and $R_2$ of the corresponding first and second rollers 101 and 102, which are used to obtain the PLD fluctuation f(t), are shifted from the corresponding references, caused by, for example, the dispersion of the diameters of the first and second rollers 101 and 102 in the manufacturing process, or the changes of the diameters in an environment change and with the passage of time, the diameter ratio can be corrected.

[First Embodiment]

Next, the renewal of the PLD fluctuation f(t) according to a first embodiment of the present invention is described. In the first embodiment, any one of the PLD fluctuation recognition methods 1 through 3 can be used. In addition, the belt driving control example 2 is used and the disposing position example 3 of the rotary encoders is used. That is, in the belt driving control example 2, the mechanism for detecting the home position of the belt 103 is not provided, and in the disposing position example 3, the rotary encoder is disposed at the motor axle of the driving motor 106 and the rotary encoders 101*a* and 102*a* are disposed in the corresponding first and second rollers 101 and 102 whose diameters are different from each other, respectively. In this case, by using the stepping motor, it is possible that the rotary encoder is not used at the motor axle of the driving motor 106.

Figure 10:
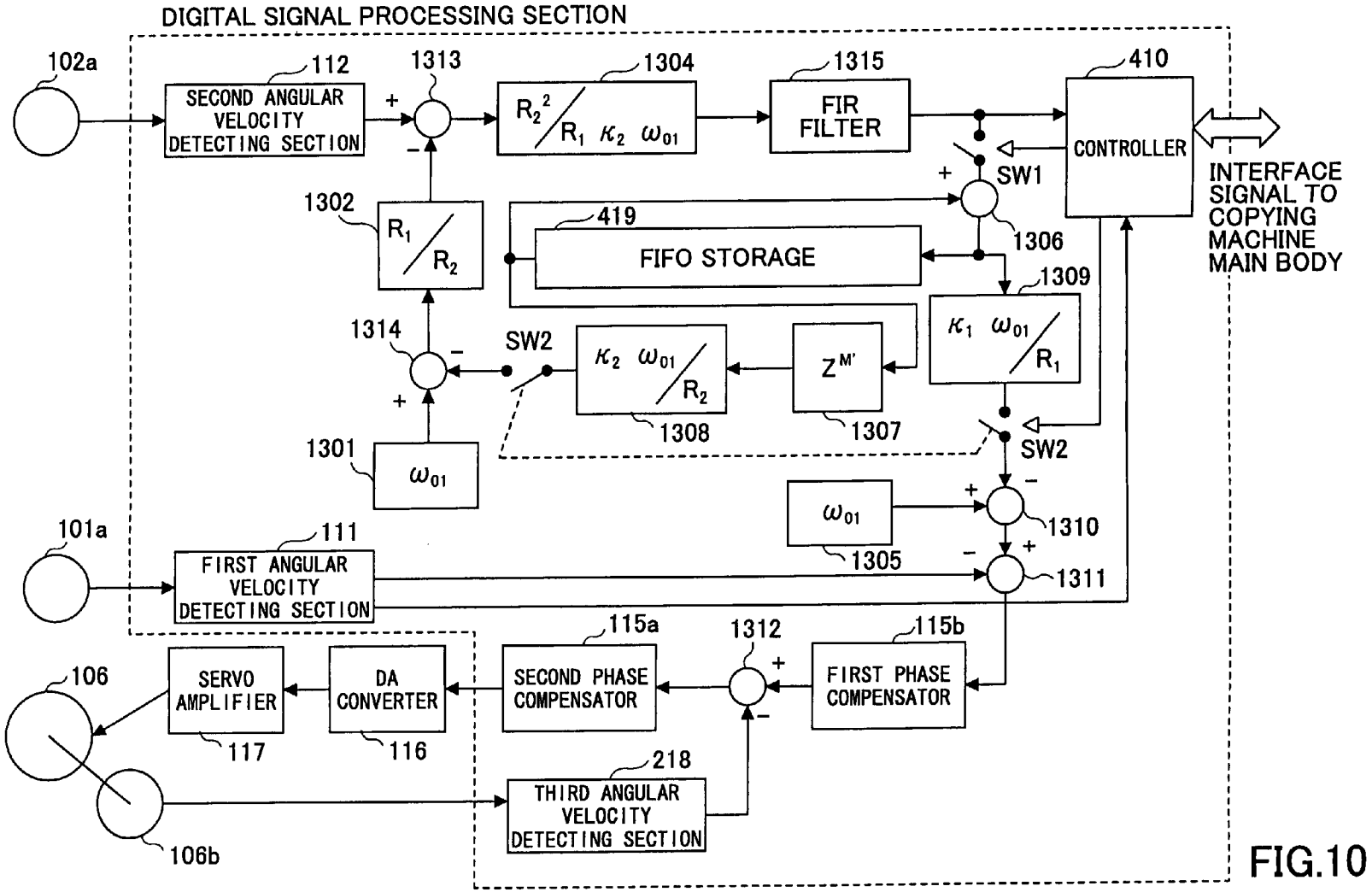
FIG. 10 is a diagram showing a structure for executing a renewal of a PLD fluctuation according to a first embodiment of the present invention.

FIG. 10 is a diagram showing a structure for executing the renewal of the PLD fluctuation according to the first embodiment of the present invention. As shown in FIG. 10, the structure includes a third rotary encoder 106*b* disposed in a DC servo motor which is used as the driving motor 106, a digital signal processing section (control unit) surrounded by a dashed line, the first rotary encoder 101*a*, the second rotary encoder 102*a*, the DA converter 116, and the servo amplifier 117.

The digital signal processing section is formed of a digital circuit, a DSP, a u CPU, a RAM, a ROM, FIFO storage, and so on. The hardware structure of the control unit is not limited to the above structure, and some elements can be operated by firmware.

Specifically, the digital signal processing section (control unit) includes a first phase compensator 115*b*; a second phase compensator 115*a*; the first angular velocity detecting section 111; the second angular velocity detecting section 112; the third angular velocity detecting section 218; a switch SW1; two switches SW2 which are operated together; blocks 1301, 1302, 1304, 1305, 1307, 1308, and 1309; an adder 1306; subtractors 1310, 1311, 1313, and 1314; a FIR filter 1315; a controller 410; and FIFO storage 419.

In the first embodiment, since the mechanism which detects the home position of the belt 103 is not included, as described in the belt driving control example 2, a phase shift occurs by shifting the virtual home position. In addition, there is a risk that the PLD fluctuation will occur due to an environment change and with the passage of time. Therefore, the PLD fluctuation f(t) obtained in the past must be renewed. In the first embodiment, it can be arbitrarily determined whether the renewal of the PLD fluctuation is performed continuously or intermittently corresponding to the workload on an operation processing section such as a CPU.

In a case where the renewal of the PLD fluctuation is intermittently executed, it is monitored whether the PLD fluctuation f(t) is within a predetermined tolerance by confirming the fluctuation of the belt moving velocity. When the PLD fluctuation f(t) exceeds the predetermined tolerance, the PLD fluctuation f(t) is renewed. Specifically, as described above, it is determined whether the absolute value, the average of the absolute values, the mean-square value, or the root-mean-square value of the absolute values of the $\epsilon(t)$ in Equation 30 is within a predetermined tolerance, and when the value of the $\epsilon(t)$ exceeds the predetermined tolerance, the PLD fluctuation f(t) is renewed. It is possible to renew the PLD fluctuation periodically corresponding to the hours of operation or the amount of operations of the copying machine. After the PLD fluctuation is renewed, when the absolute value, the average of the absolute values, the mean-square value, or the root-mean-square value of the absolute values of the $\epsilon(t)$ in Equation 30 is not within the predetermined tolerance, since initial values as the premises have some errors, the errors are reported.

The first embodiment of the present invention is described in detail. First, the controller 410 turns off the switch SW1 and the two switches SW2 which are operated with together, compares the reference signal data $\omega_{01}$ ($=V_0/R_1$) of the rotation angle velocity with the rotation angle velocity $\omega_1$ of the first roller 101 detected by the first angular velocity detecting section 111, and drives the belt 103 so that the rotation angle velocity of the first roller 101 becomes the constant rotation angle velocity (the reference signal data) $\omega_{01}$. The first and second phase compensators 115*a* and 115*b* reduce general errors and function to execute stable feedback control. When the rotation angle velocity $\omega_1$ of the first roller 101 becomes the constant rotation angle velocity $\omega_{01}$, the rotation angle velocity $\omega_2$ of the second roller 102 detected by the second angular velocity detecting section 112 becomes a velocity shown in Equation 33, from Equation 6.

$$\omega_2 = \frac{R_1}{R_2}\omega_{01} + \frac{\kappa_2 R_1}{R_2^2}\omega_{01}\{Gf(tn-\tau) - f(tn)\} \quad \text{[Equation 33]}$$

Where "G" is the same as that shown in Equation 9. In addition, in the first embodiment, since digital processing is executed, instead of using the time "t", "tn" which is expressed discretely is used.

Therefore, the above PLD fluctuation f(t) is replaced by the PLD fluctuation f(tn).

The PLD fluctuation f(tn) is obtained from the rotation angle velocity $\omega_2$ of the second roller 102, and data of the PLD fluctuation f(tn) in one round of the belt 103 are stored in the FIFO storage 419 (belt thickness fluctuation data storage). In this process, at conditions in which the switches SW1 and SW2 are turned off, fixed data $(R_1 \cdot \omega_{01})/R_2$ operated on at the block 1302 are subtracted from the detected rotation angle velocity $\omega_2$ of the second roller 102 at the subtractor 1313. Data output from the subtractor 1313 are multiplied by fixed data $R_2^2/(R1 \cdot \kappa_2 \cdot \omega_{01})$ at the block 1304 and data output from the block 1304 are input to the FIR filter 1315.

That is, the data output from the block 1304 are $Gf(tn-\tau)-f(tn)$ and are input to the FIR filter 1315. Data output from the FIR filter 1315 become data fn ($n^{th}$ time discrete PLD fluctuation data) of which a data string of the PLD fluctuation $f(tn-\tau)$ is composed.

The controller 410 monitors the rotation angle velocity $\omega_1$ of the first roller 101, and when the rotation angle velocity $\omega_1$ is a constant velocity, and after a time is passed in which normal PLD fluctuation data fn are output from the FIR filter 1315, the controller 410 turns on the switch SW1.

Since the FIR filter 1315 includes a delay element, at the filtering initial time the normal PLD fluctuation data fn are not output. Therefore, the above operation is executed. When the controller 410 confirms that the belt 103 moves around by counting the number of pulses output from the first rotary encoder 101*a* of the first roller 101, the controller 410 turns off the switch SW1. The data of the PLD fluctuation f(tn) output from the FIR filter 1315 are stored in the FIFO storage 419 which can store the data fn of the PLD fluctuation f(tn) of one round of the belt 103. In the first embodiment, when the FIFO storage 419 is empty, the switch SW1 is turned on and the data fn of the PLD fluctuation f(tn) are stored in the FIFO storage 419.

As described above, the data fn of the PLD fluctuation f(tn) are stored in the FIFO storage 419 corresponding to the rotation of the belt 103. When the rotation angle velocity reference data $\omega_{ref1}$ of the first roller 101 are obtained by using the stored data of the PLD fluctuation f(tn) corresponding to Equation 34, the belt driving control corresponding to the PLD fluctuation f(tn−τ) is executed.

$$\omega_{ref1} = \omega_{01}\left\{1 - \frac{\kappa_1}{R_1} f(tn - \tau)\right\} \quad \text{[Equation 34]}$$

Operations in the parentheses of Equation 34 are executed by the block 1309. When the two switches SW2 are turned on, the data of the rotation angle velocity reference $\omega_{ref1}$ of the first roller 101 are output from the subtractor 1310.

In addition, when the two switches SW2 are turned on, the control errors $\Delta\omega_{2\epsilon}$ shown in Equation 31 are detected. In this operation, first, the rotation angle velocity fluctuation of the second roller 102, which is predicted from the data of the PLD fluctuation f(tn) stored in the FIFO storage 419, is operated in the blocks 1307 and 1308. The constant rotation angle velocity $\omega_{01}$ in the block 1301 is added to the rotation angle velocity fluctuation of the second roller 102, and the added result is operated on in the block 1302. The operated result is subtracted from the rotation angle velocity $\omega_2$ detected at the second angular velocity detecting section 112 in the subtractor 1313. In this, the belt carrying time τ' from the second roller 102 to the first roller 101 is determined to be M'×Ts (M is an integer). The output from the subtractor 1313 becomes $\Delta\omega_{2\epsilon}$ shown in Equation 31 and is input to the block 1304.

Then, the output from the block 1304 is input to the FIR filter 1315, and the output from the FIR filter 1315 is input to the controller 410 as the PLD fluctuation error data ϵn. When the PLD fluctuation error data ϵn exceed a predetermined value, the controller 410 turns on the switch SW1 for only a period corresponding to the one round of the belt 103, obtains new data fn of the PLD fluctuation f(tn), and stores the new data in the FIFO storage 419; that is, the controller 410 renews the data of the PLD fluctuation f(tn). In this, when the switches SW1 and SW2 are turned on where the PLD fluctuation data before being renewed are stored in the FIFO storage 419, a revision of the PLD fluctuation data shown in Equation 32 is executed in the adder 1306 and the revised PLD fluctuation data are stored in the FIFO storage 419.

In this, when the data fn of the PLD fluctuation f(tn) are store in the FIFO storage 419, it is possible that the data fn of the PLD fluctuation f(tn) of the plural round times of the belt 103 are obtained and averaged data of the obtained data are stored in the FIFO storage 419. In this case, the FIFO storage 419 also functions as a past information storing unit. In addition, similarly, it is possible that the PLD fluctuation error data ϵn of the plural round times of the belt 103 are obtained and averaged data of the obtained data are used. In this case, errors caused by random fluctuations generated by backlash and noise of gears can be deduced.

Next, a case in which the renewal of the PLD fluctuation f(tn) is continuously executed is described. In this case, the revision of the PLD fluctuation shown in Equation 25 is always executed. That is, in FIG. 10, the switches SW1 and SW2 are turned on.

Specifically, first, when the FIFO storage 419 is empty, the controller 410 turns off the SW1, compares the reference signal data $\omega_{01}$ with the rotation angle velocity $\omega_1$ of the first roller 101 detected by the first angular velocity detecting section 111, and drives the belt 103 so that the rotation angle velocity of the first roller 101 becomes the constant rotation angle velocity (the reference signal data) $\omega_{01}$. When the output from the FIR filter 1315 becomes stable, the controller 410 turns on the switch SW1 and stores the data fn of the PLD fluctuation f(tn) of the one round of the belt 103 in the FIFO storage 419. After this, when the controller 410 turns on the switches SW1 and SW2, data in which the data ϵn output from the FIR filter 1315 and the data output from the FIFO storage 419 are added and the added data are input to the FIFO storage 419. The input data are data fn of the new PLD fluctuation f(tn). The data ϵn are PLD fluctuation error data obtained from the output of the FIR filter 1315 by the relationship shown in Equations 22 and 24. In this case, the data fn of the PLD fluctuation f(tn) in which the errors are corrected are stored in the FIFO storage 419 corresponding to the one round of the belt 103. When the reference data $\omega_{ref1}$ of the first roller 101 are generated corresponding to Equation 34 by using the data fn of the PLD fluctuation f(tn), the belt driving control corresponding to the PLD fluctuation f(tn) is executed. At this time, when the controller 410 determines that the PLD fluctuation error data ϵn exceed a predetermined value, the controller 410 reports abnormal conditions to the copying machine.

In the first embodiment of the present invention, the data of the PLD fluctuation f(tn) are held in the FIFO storage 419 in which input data are shifted by a clock signal or in a memory function of the block 1307 in which input data are output by being delayed by a certain period. However, the memory function can be realized by a memory unit in which addresses are managed.

[Second Embodiment]

Next, the renewal of the PLD fluctuation f(tn) according to a second embodiment of the present invention is described. In the first embodiment, the data fn of the PLD fluctuation f(tn) are revised; however, in the second embodiment, the data fn of the PLD fluctuation f(tn) are not revised but newly obtained data fn of the PLD fluctuation f(tn) are stored in the FIFO storage 419 in order. In the following, the newly obtained data fn are stored in the FIFO storage 419 in order and the PLD fluctuation f(tn) is renewed by using the data of the PLD fluctuation f(tn) of the previous one round of the belt 103.

Figure 11:
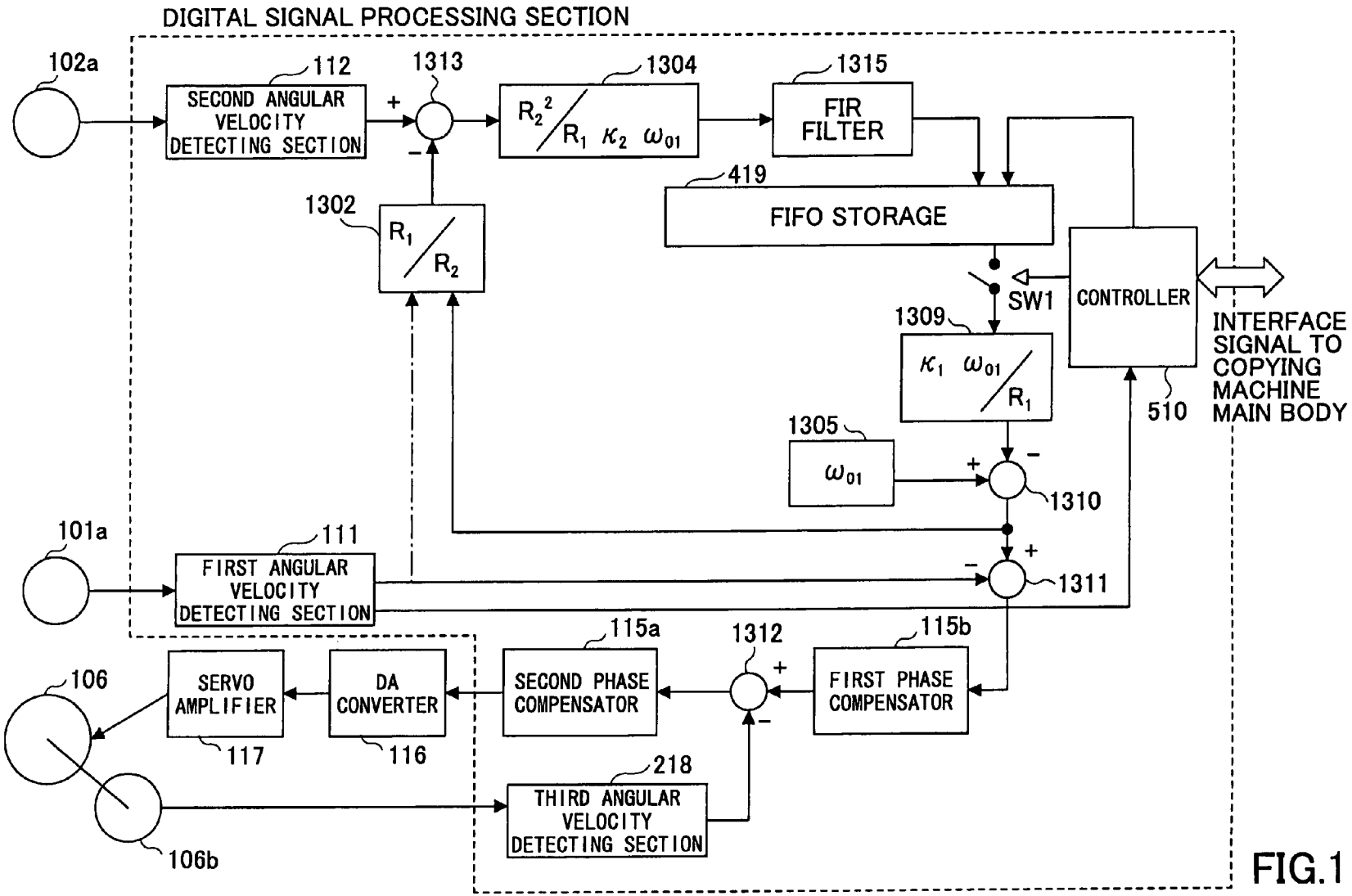
FIG. 11 is a diagram showing a structure for executing the renewal of the PLD fluctuation according to a second embodiment of the present invention.
Figure 12:
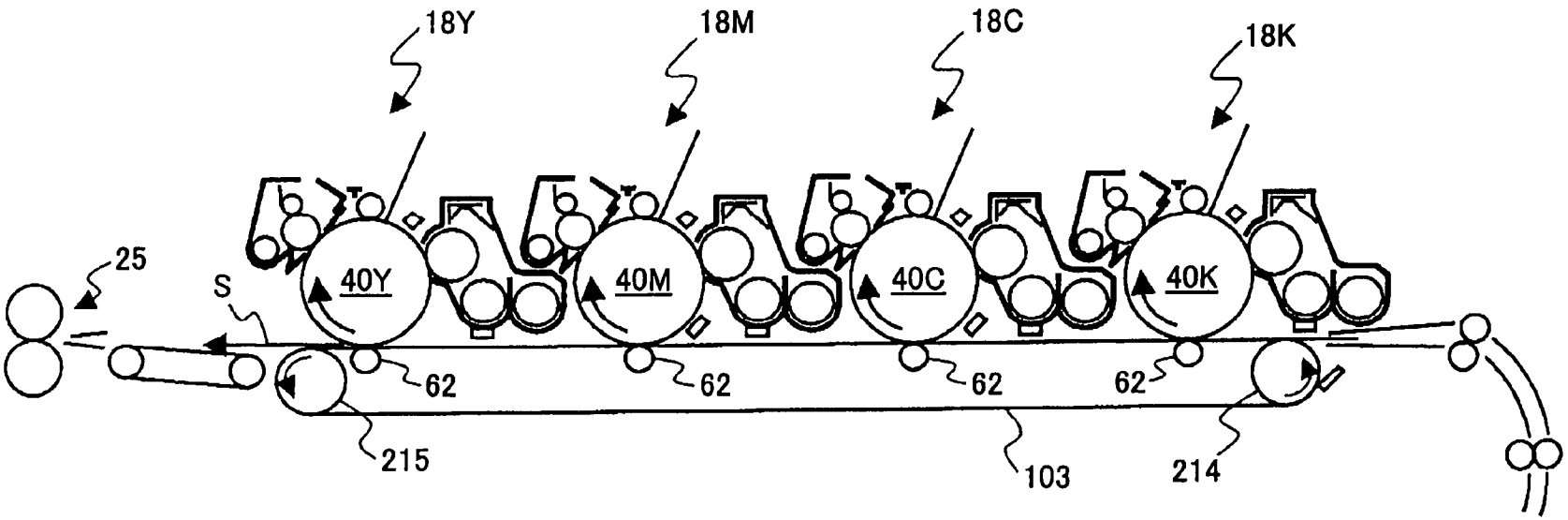
FIG. 12 is a diagram showing a part of a tandem type image forming apparatus which uses a direct image transfer system.
Figure 13:
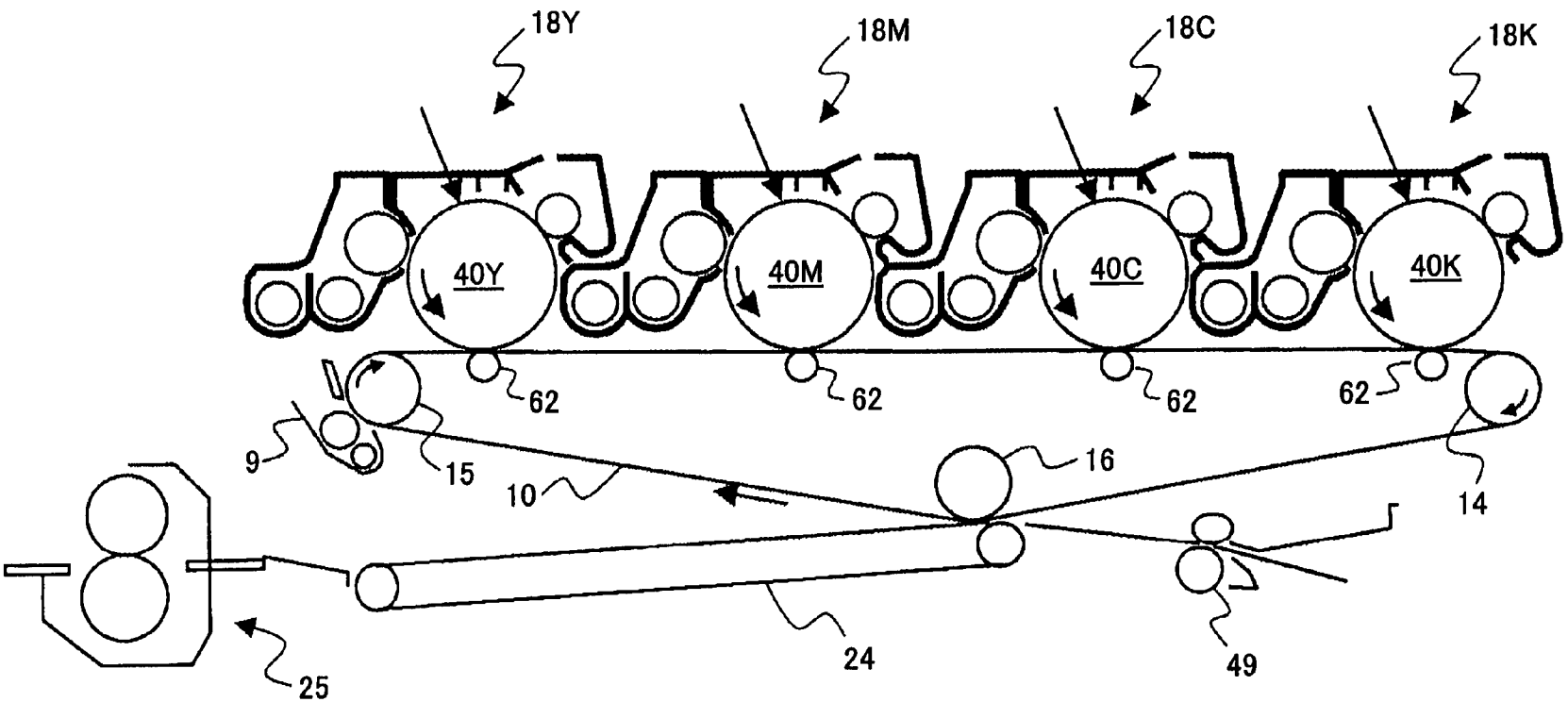
FIG. 13 is a diagram showing a part of a tandem type image forming apparatus which uses an intermediate image transfer system.
Figure 14:
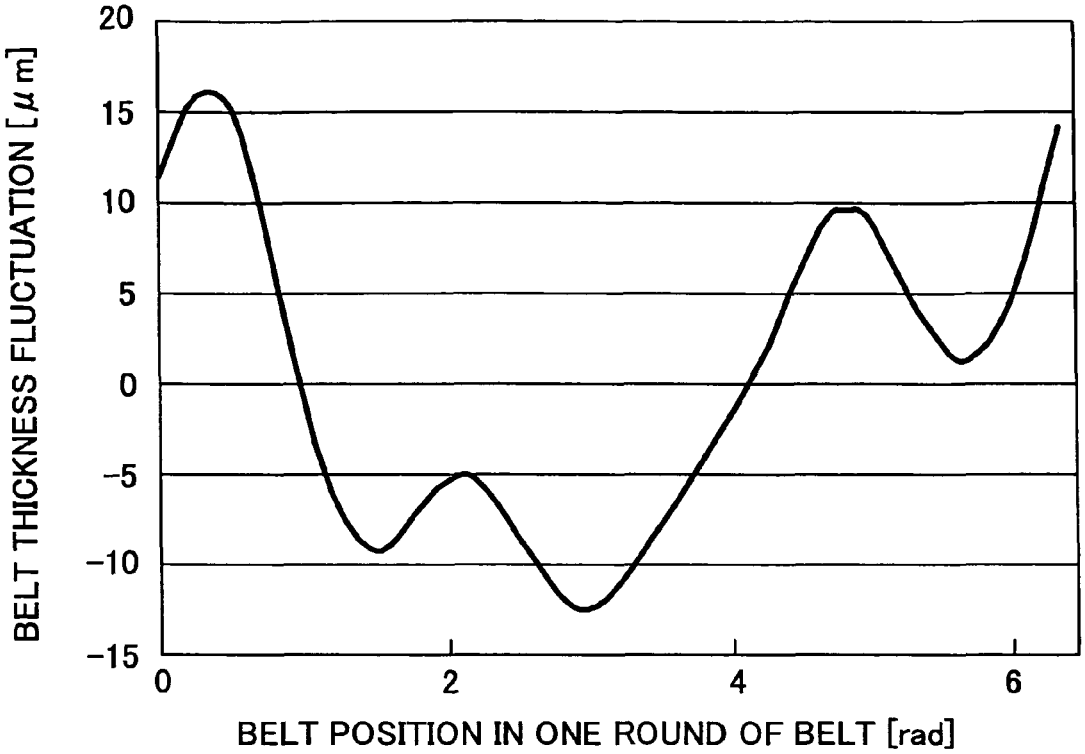
FIG. 14 is a graph showing an example of a belt thickness fluctuation in the moving direction of an intermediate transfer belt shown in FIG. 13.

FIG. 11 is a diagram showing a structure for executing the renewal of the PLD fluctuation according to the second embodiment of the present invention. When the structure shown in FIG. 11 of the second embodiment is compared with the structure shown in FIG. 10 of the first embodiment, in the second embodiment, the two switches SW2; the blocks 1301, 1307, and 1308; the adder 1306; and the subtractor 1314 shown in FIG. 10 are not included. In addition, in the second embodiment, a controller 510 is included instead of the controller 410 in the first embodiment. In FIG. 11, similar to those shown in FIG. 10, the driving motor 106 is a DC servo motor, and a digital signal processing section (control unit) surrounded by a dashed line is formed of a digital circuit, a DSP, a p CPU, a RAM, a ROM, FIFO storage, and so on. The hardware structure of the control unit is not limited to the above structure, and some elements can be operated by firmware.

First, the rotation angle velocity $\omega_2$ of the second roller 102 is detected, and new data gn of the PLD fluctuation f(tn) are obtained from data in which the reference data $\omega_{ref1}$ are removed from the data fn of the PLD fluctuation f(tn) stored in the FIFO storage 419. That is, a rotation angle velocity $\omega_2'$ of the second roller 102 is detected by setting the virtual home position as a reference, while the belt driving control is executed based on the data fn of the PLD fluctuation f(tn) stored in the FIFO storage 419. Then, the reference data $\omega_{ref1}$ are multiplied by $(R_1/R_2)$ and the multiplied result is subtracted from the rotation angle velocity $\omega_2'$; then new reference data are obtained by using a signal $\omega_2''$ obtained from the subtracted result. The belt driving control is executed by the new reference data.

The rotation angle velocity $\omega_2'$ of the second roller 102 to be detected by setting the virtual home position as the reference is shown in Equation 35.

$$\omega_2' = \frac{R_1\omega_{01}}{R_2}\left[1 + \frac{\kappa_1}{R_1}\{g(tn-\tau) - f(tn-\tau)\} - \frac{\kappa_2}{R_2}\{g(tn)\}\right] \quad \text{[Equation 35]}$$

The signal $\omega_2''$ is obtained from Equation 36.

$$\omega_2'' = \omega_2' - \frac{R_1}{R_2}\omega_{ref1} \quad \text{[Equation 36]}$$

Therefore, Equation 37 is obtained from Equation 35 and Equation 36. The "G" in Equation 37 is the same as that in Equation 9 and is a value greater than 1 from the relationship of the roller diameter ratio between the first roller 101 and the second roller 102 in the second embodiment.

$$\omega_2'' = \frac{\kappa_1}{R_2}\omega_{01}\{Gg(tn-\tau) - g(tn)\} \quad \text{[Equation 37]}$$

The data gn of the PLD fluctuation g(tn) can be obtained from Equation 37. Specifically, for example, a data string of new data gn of the PLD fluctuation g(tn) is obtained from the FIR filter 1315.

In FIG. 11, the controller 510 turns off the switch SW1, compares the reference signal data $\omega_{01}$ $(=V_0/R_1)$ with the rotation angle velocity $\omega_1$ of the first roller 101 detected by the first angular velocity detecting section 111, and drives the belt 103 so that the rotation angle velocity of the first roller 101 becomes a constant rotation angle velocity (the reference signal data) $\omega_{01}$. When the rotation angle velocity $\omega_1$ of the first roller 101 becomes the constant rotation angle velocity $\omega_{01}$, the rotation angle velocity $\omega_2$ of the second roller 102 detected by the second angular velocity detecting section 112 becomes a value shown in Equation 38.

$$\omega_2 = \frac{R_1\omega_{01}}{R_2}\left[1 + \frac{\kappa_1}{R_1}\{f(tn)\} - \frac{\kappa_2}{R_2}\{f(tn-\tau)\}\right] \quad \text{[Equation 38]}$$

The $\omega_{01}$ output from the subtractor 1310 is multiplied by $(R_1/R_2)$ at the block 1302, and fixed data $(R_1\cdot\omega_{01})/R_2$ are input to the subtractor 1313. Data output from the subtractor 1313 are multiplied by fixed data $R_2^2/(R_1\cdot\kappa_1\cdot\omega_{01})$ at the block 1304. Data output from the block 1304 are input to the FIR filter 1315. That is, the data output from the block 1304 are Gf(tn−τ)−f(tn) and are input to the FIR filter 1315.

Data output from the FIR filter 1315 become the data fn of the PLD fluctuation f(tn) of which a data string of the PLD fluctuation f(tn−τ) is composed. The controller 510 monitors the rotation angle velocity $\omega_1$ of the first roller 101; when the rotation angle velocity $\omega_1$ is a constant velocity, and after a time in which normal data fn of the PLD fluctuation f(tn) are output from the FIR filter 1315 is passed, the controller 510 turns on the switch SW1. Since the FIR filter 1315 includes a delay element, at the filtering initial time, the normal data fn of the PLD fluctuation f(tn) are not output. Therefore, the above operation is executed. When the reference data $\omega_{ref1}$ of the first roller 101 are obtained by Equation 34 by using the data fn of the PLD fluctuation f(tn) at the block 1309, belt driving control corresponding to the PLD fluctuation f(tn−τ) is executed.

In the second embodiment, the FIFO storage 419 is disposed in a structure in which a time is required in operations for obtaining the data fn of the PLD fluctuation or in digital signal processing including the multiplication at the block 1309. That is, the reference data $\omega_{ref1}$ are generated by the data fn of the PLD fluctuation of the previous one round of the belt 103. In addition, since the rotation angle velocity $\omega_1$ of the first roller 101 is controlled by the reference data $\omega_{ref1}$, as shown in an alternate long and short dashed line in FIG. 11, a structure can be used in which the rotation angle velocity $\omega_1$ of the first roller 101 is directly input to the block 1302.

In addition, in the second embodiment, when DC component errors caused by dispersion of the diameters of the first roller 101 and the second roller 102 in a manufacturing process, a temperature change, or operation errors are included in the signal $\omega_2''$, errors occur in the FIR filtering process of the FIR filter 1315. When the errors are large, a high pass filter which removes DC components of the signal $\omega_2''$ is disposed before the FIR filter 1315.

In addition, in the first and second embodiments, in order to remove fluctuations in rotation cycles of the first roller 101 and the second roller 102, other cyclic fluctuations, and fluctuations in a high frequency region including noise, a low pass filter can be disposed, based on the rotation angle velocity $\omega_2$ of the second roller 102 detected by the second angular velocity detecting section 112. With this, correction control of the belt moving velocity fluctuation caused by the PLD fluctuation can be stably executed at high accuracy. The low pass filter is disposed in front of the FIR filter 1315 or behind the second angular velocity detecting section 112.

In addition, in order to reduce random detection errors caused by backlash and/or noise of gears, an averaging process can be used. That is, the data fn of the PLD fluctuation of "N" rounds of the belt 103 (N is an integer) are input to a RAM in a first-in first-out system, the data fn of "N" rounds or less are averaged, and the averaged data are used as the data fn of the PLD fluctuation. When the data of the PLD fluctuation are continuously renewed, the data fn of the PLD fluctuation from the previous round to at most the $N^{th}$ previous round are averaged and the reference data are generated.

In addition, in the first and second embodiments, the reference data $\omega_{ref1}$ showing the rotation angle velocity are converted into rotation angle displacement, and control is executed by comparing the converted rotation angle displacement with the rotation angle displacement obtained from the output of the first rotary encoder 101*a* disposed in the first roller 101. This is also possible.

In addition, in the first and second embodiments, in order to continuously control outputting pulse phases based on the output from the first rotary encoder 101*a* disposed in the first roller 101, the reference data $\omega_{ref1}$ are converted into a pulse string and PLL control is executed. This is also possible.

[Belt Driving Controller]

A belt driving controller according to the first and second embodiments controls driving the belt 103 by controlling the rotation of the driving roller 105 in the rollers 101, 102, and 105 around which the belt 103 is wound. The belt driving controller includes the digital signal processing section (control unit). The digital signal processing section controls the rotation of the driving roller 105 so that the fluctuation of the belt moving velocity V caused by the PLD fluctuation of the belt 103 in the circumference direction becomes small based on detected results of the rotation angle displacements or the rotation angle velocities of the first roller 101 and the second roller 102. In this, in the first roller 101 and the second roller 102, the roller effective radii $R_1$ and $R_2$ are different from each other, and/or degrees, in which the PLDs of belt parts wound around the two rollers influence a relationship between the belt moving velocity V and the roller rotation angle velocities $\omega_1$ and $\omega_2$ of the first and second rollers 101 and 102, are different from each other.

In the first and second embodiments, the digital signal processing section obtains the PLD fluctuation f(t), by setting an arbitrary position on the moving route of the belt 103 as a virtual home position, and executes the above rotation control by using the PLD fluctuation f(t). In the belt driving controller, as described above, the sizes of the PLD fluctuations in the belt circumference direction, which are detected by the rotation angle velocities $\omega_1$ and $\omega_2$ of the driven rollers 101 and 102 are different, caused by the difference of the roller effective radii $R_1$ and $R_2$, the difference of the belt winding angles $\theta_1$ and $\theta_2$, the difference of the belt materials, and the difference of the belt layer structures. The belt driving controller, by utilizing the above differences, can specify the PLD fluctuation which influences the relationship between the belt moving velocity V and the rotation angle velocities $\omega_1$ and $\omega_2$ of the first and second rollers 101 and 102 by using the rotation angle displacements or the rotation angle velocities $\omega_1$ and $\omega_2$ of the first and second rollers 101 and 102. Even if the fluctuation is complex, the PLD fluctuation can be specified at high accuracy. Therefore, the driving of the belt 103 can be controlled at high accuracy so that the fluctuation of the belt moving velocity V becomes small.

When the belt 103 is a single layer belt whose material is uniform, the belt driving control can be executed by using a belt thickness fluctuation which has a constant relationship with the PLD fluctuation. That is, based on detected results of the rotation angle displacements or the rotation angle velocities of the first and second rollers 101 and 102, the rotation control of the driving roller 105 is executed so that the fluctuation of the belt moving velocity V caused by the belt thickness fluctuation in the belt circumference direction of the belt 103 becomes small. In this, in the first roller 101 and the second roller 102, the roller effective radii are different, and/or the degrees, in which the thicknesses of belt parts wound around the two rollers influence a relationship between the belt moving velocity V and the roller rotation angle velocities $\omega_1$ and $\omega_2$ of the first and second rollers 101 and 102, are different from each other.

In addition, in the first and second embodiments, as described above, the FIFO storage 419 is provided to store the information of the PLD fluctuation f(t) (rotation fluctuation information) in the period Tb during which the belt 103 moves around. With this, an operation period for recognition and correction of the PLD fluctuation f(t) and other operation period can be obtained.

Further, the information of the PLD fluctuation f(t) is obtained again at predetermined timing. With this, at timing in which the PLD fluctuation f(t) of the belt 103 changes beyond the tolerance caused by an environment change and with the passage of time, the PLD fluctuation f(t) can be obtained again. As a result, even if the PLD fluctuation f(t) of the belt 103 changes, the belt driving control can be maintained at high accuracy. Especially, as described in the first embodiment, when the predetermined timing is selected as timing in which a difference between PLD fluctuation data which are predicted based on the moving position of the belt 103 and the information of the PLD fluctuation f(t) (rotation fluctuation information) and actual PLD fluctuation data exceed the tolerance, the belt driving control can be stably maintained at high accuracy.

In addition, as described in the second embodiment, the rotation control of the driving roller 105 can be executed while obtaining the information of the PLD fluctuation f(t). In this case, the belt driving control can be stably maintained at high accuracy. Further, in this case, since it is not necessary to store the information of the PLD fluctuation f(t) of one round of the belt 103, a memory unit for storing the information of the PLF fluctuation f(t) is not needed.

In addition, it is possible that the FIFO storage 419 stores the past information of the PLD fluctuation f(t) of at least one round of the belt 103. In this case, the rotation control of the driving roller 105 can be executed by using averaged information in which the past information and newly obtained information of the PLD fluctuations f(t) are averaged. In this case, since the averaged information of the past information and the newly obtained information are used, the information of the PLD fluctuation f(t) can be obtained at higher accuracy. With this, the influence of detection errors caused by random fluctuations generated by backlash and noise of gears can be decreased.

[Belt Rotating Device]

A belt rotating device according to the first and second embodiments of the present invention includes plural sustaining rotation bodies (including the first roller 101, the second roller 102, and the driving roller 105), the belt 103, the driving motor 106, the first and second rotary encoders 101*a* and 101*b*, and the first and second angular velocity detecting sections 111 and 112. The belt 103 is wound around the sustaining rotation bodies including the first and second rollers 101 and 102 and the driving roller 105. The driving motor 106 (driving source) rotates the driving roller 105. In the first roller 101 and the second roller 102, the roller radii are different from each other, and/or the degrees in which the PLDs of parts of the belt 103 wound around the two rollers 101 and 102 influence the relationship between the belt moving velocity V and the rotation angle velocities $\omega_1$ and $\omega_2$ of the corresponding first and second rollers 101 and 102 are different from each other. The first angular velocity detecting section 111 detects the rotation angle velocity $\omega_1$ of the first roller 101 from information of the first rotary encoder 101*a*, and the second angular velocity detecting section 112 detects the rotation angle velocity $\omega_2$ of the second roller 102 from information of the second rotary encoder 102*a*.

The belt rotating device uses the belt driving controller which controls driving the belt 103 by controlling the rotation of the driving roller 105 to which a rotation driving force is transmitted from the driving motor 106. With this, the belt rotating device can execute the driving control of the belt 103 at high accuracy.

In addition, in the disposing position example 1 of the rotary encoders, the two rollers 101 and 102 are driven rollers which are rotated by the movement of the belt 103. In this case, when the PLD fluctuation f(t) is obtained, fluctuation components (sliding contact between the driving roller 105 and the belt 103 and so on) which become recognition error factors do not influence the PLD fluctuation f(t). Therefore, the PLD fluctuation f(t) can be obtained at higher accuracy.

Especially, as described in the disposing position example 3 of the rotary encoders, when the rotation angle displacement or the rotation angle velocity $\omega_m$ of the driving motor 106 (driving roller 105) is detected and a feedback control unit is used, which control unit controls so that the detected rotation angle displacement or the detected rotation angle velocity $\omega_m$ becomes target rotation angle displacement or a target rotation angle velocity, a more stable belt driving controller can be designed. In addition, since the PLD fluctuation effective coefficients $\kappa_1$ and $\kappa_2$ of the driven rollers 101 and 102 can be corrected, the PLD fluctuation f(t) can be obtained at higher accuracy.

In addition, as described in the disposing position example 2 of the rotary encoders, in order to obtain the information of the PLD fluctuation f(t), as one of the two rollers from which the rotation angle displacement or the rotation angle velocities are obtained, the driving roller 105 is selected. In this case, a detecting unit, which detects the rotation angle displacement or the rotation angle velocity of the driving roller 105, detects the rotation angle displacement or the rotation angle velocity $\omega_m$ of the driving motor 106, or detects a target rotation angle displacement or a target rotation angle velocity to be input to the driving motor 106. Then, the detected result is used as the rotation angle displacement or the rotation angle velocity of the driving roller 105. When as the driving motor 106, for example, a pulse motor is used, only one rotary encoder is required, and the cost can be reduced. That is, since one of the rotation angle displacement or the rotation angle velocity for obtaining the information of the PLD fluctuation f(t) is the rotation angle displacement or the rotation angle velocity of the driving roller 105 which can be ensured as a constant, the information of the PLD fluctuation f(t) can be obtained from only the rotation angle displacement or the rotation angle velocity $\omega_2$ of the other roller (the first roller 101 or the second roller 102).

In addition, as described in the belt driving control example 1, in order to obtain the reference belt moving position of the belt 103, the mark detecting sensor 104 which detects the home position mark 103*a* showing the reference position on the belt 103 is disposed. The relationship between the belt moving position corresponding to the obtained information of the PLD fluctuation f(t) and the actual belt moving position is obtained at detecting timing of the mark detecting sensor 104, and the rotation control of the driving roller 105 is executed. With this, since the reference position on the belt for one round can be determined, the obtained information of PLD fluctuation f(t) can be used in the belt driving control where the obtained information of the PLD fluctuation f(t) matches the PLD fluctuation of the belt 103. That is, the belt driving control can be suitably executed.

In addition, as described in the belt driving control example 2, the relationship between the belt moving position corresponding to the obtained information of the PLD fluctuation f(t) and the actual belt moving position is obtained based on an average time, which average time is obtained beforehand as the time which the belt 103 needs to move one round, or the belt circumference length which is obtained beforehand, and the rotation control of the driving roller 105 is executed. With this, without disposing the home position mark 103*a* on the belt 103 and the mark detecting sensor 104, the reference position (virtual home position) in one round of the belt can be determined. Therefore, the cost can be lowered.

In addition, as described in the PLD fluctuation recognition method 1, the distance between the first roller 101 and the second roller 102 (belt circumference direction distance) is set so that the tolerance of each frequency component generated by the approximation $f(t)=f(t-\tau)$ is within the predetermined total position shift error. With this, even if the approximation $f(t)=f(t-\tau)$ is used, the information of the PLD fluctuation f(t) can be obtained at sufficiently high accuracy.

In addition, when the belt 103 is a seam belt which has a seam part at least at one position in the belt circumference direction, the seam part may be thicker than the other parts and/or the stretch of the seam part may be different from that of the other parts caused by changing the property of the material. In this case, even if the thickness of the seam part is the same as that of the other parts, the PLD of the seam part may be largely different from that of the other parts. However, according to the belt driving controller in the embodiments of the present invention, as described above, even if a belt has a large PLD fluctuation, the PLD fluctuation can be specified at high accuracy. Therefore, in such a seam belt, the belt driving control can be executed at high accuracy by restraining the belt velocity fluctuation generated suddenly when the seam part winds around the driving roller 105.

Further, when the belt 103 is a plural-layer belt which has plural layers in the belt thickness direction, even if the thickness is uniform, the belt velocity fluctuation may occur due to the PLD fluctuation caused by the layer structure. However, according to the belt driving controller in the embodiments of the present invention, as described above, since the PLD fluctuation is specified and the belt driving control is executed based on the specified PLD fluctuation, the belt driving control can be executed at high accuracy in the plural-layer belt.

Figure 17:
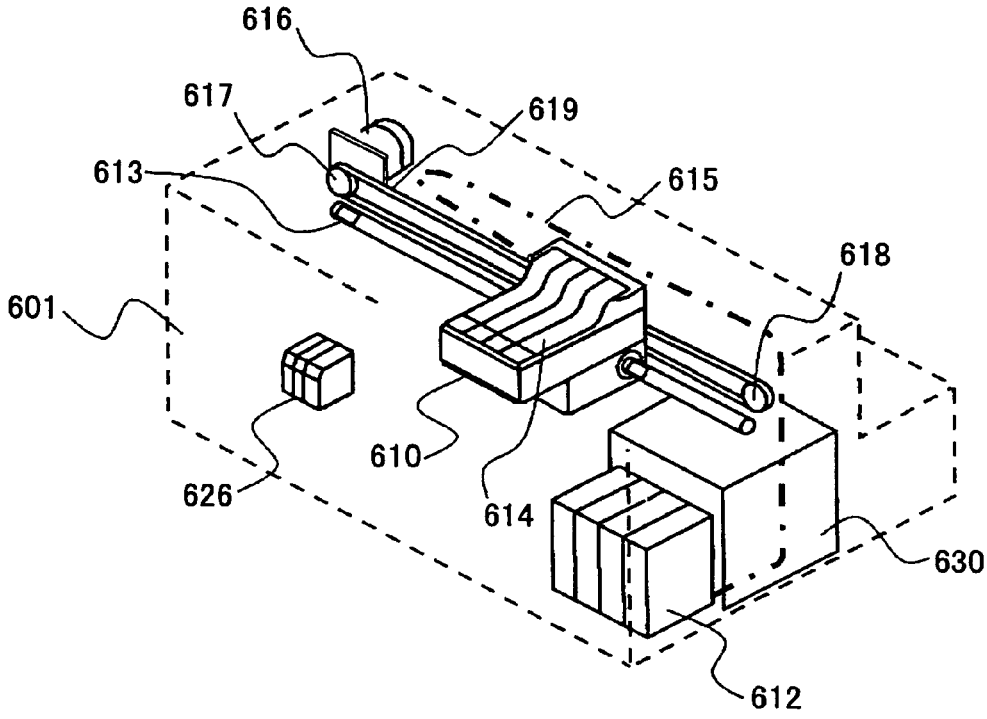
FIG. 17 is a perspective view of a part of an internal structure of an image forming apparatus according to the embodiments of the present invention.

FIG. 17 is a perspective view of a part of an internal structure of an image forming apparatus according to the embodiments of the present invention. In FIG. 17, as the image forming apparatus, an inkjet recording apparatus is used. Referring to FIG. 17, a driving system using a timing belt of the inkjet recording apparatus is described.

The inkjet recording apparatus includes an apparatus main body 601, a carriage 610, an ink cartridge 612, a main guide rod 613, an ink sub tank 614, an ink supplying tube 615, a main scanning direction motor 616, a driving pulley 617, a driven pulley 618, a timing belt 619, a sub scanning direction motor 626, and a head maintaining and recovering mechanism 630.

The driving pulley 617 and the driven pulley 618 have plural cogs in the rotating direction and the timing belt 619 has plural cogs to engage with the cogs of the driving pulley 617 and the driven pulley 618. In this case, a PLD fluctuation occurs in the timing belt 619 and a belt moving velocity fluctuation is generated. That is, the PLD fluctuation of the belt occurs without limitation to the shape and the structure of the belt, and the belt moving velocity fluctuates when the PLD fluctuation occurs. Therefore, not only in the intermediate transfer belt 10 which is driven by friction with the surfaces of the sustaining rollers but also in a belt having cogs such as the timing belt 619, the belt moving velocity fluctuates caused by the PLD fluctuation. As described above, even in this kind of belt, the PLD fluctuation is specified and the driving control of the belt can be executed at high accuracy based on the specified PLD fluctuation.

In the above description, mainly, the rotation angle velocity is used; however, the rotation angle displacement can be used. That is, the rotation angle displacement is obtained by integrating the rotation angle velocities, and the relationship between the PLD fluctuation f(t) and the rotation angle displacement of the roller can be similarly obtained. Specifically, a rotation angle displacement fluctuation is obtained by removing an average increment (gradient components of the rotation angle displacement) from the detected rotation angle displacement, and the PLD fluctuation f(t) is obtained from the rotation angle displacement fluctuation by using the PLD fluctuation recognition method 1, 2, or 3.

Further, in the embodiments of the present invention, in a case where the belt 103 moves in reverse, when it is considered that the belt 103 is moving, it is enough that the delay period $\tau$ is replaced by $Tb-\tau$(Tb: belt one round time). At this time, $2(Tb-\tau)=2Tb-2\tau \rightarrow Tb-2\tau$ is set, and in a case of $N(Tb-\tau)$ (N is an integer), $N(Tb-\tau) \rightarrow Tb-N\tau$ is set. That is, when the PLD fluctuation f(t) is obtained by using the FIR filter described in the PLD fluctuation recognition method 2, the delay period process becomes large when $N(Tb-\tau)$ is used; however, actually, almost the same result can be obtained by using $Tb-N\tau$.

In addition, in the embodiments of the present invention, the driving control of the intermediate transfer belt in the tandem type image forming apparatus is mainly described. However, as described above, the embodiments of the present invention can be utilized in the driving control of a belt (paper carrying belt, photoconductor belt, fixing belt, and so on) which is used in an image forming apparatus using an electrophotographic technology, an inkjet technology, or a printing technology. That is, the embodiments of the present invention can be utilized in an apparatus which requires high accuracy in the belt driving control. Further, the apparatus is not limited to the image forming apparatus; when the apparatus needs highly accurate control of belt driving, the embodiments of the present invention can be utilized in the apparatus.

Further, the present invention is not limited to the specifically disclosed embodiments, and variations and modifications may be made without departing from the scope of the present invention.

The present invention is based on Japanese Priority Patent Application No. 2007-006413, filed on Jan. 15, 2007, with the Japanese Patent Office, the entire contents of which are hereby incorporated herein by reference.

What is claimed is:

1. A belt driving controller, which controls driving of a belt that is wound around a plurality of sustaining rotation bodies including a driven sustaining rotation body that is rotated together with a movement of the belt and a driving sustaining rotation body that transmits a driving force to the belt, comprising:

a control unit, which controls the driving of the belt so that a moving velocity fluctuation of the belt caused by a pitch line distance fluctuation in the belt circumference direction becomes small, based on rotation information of rotation angle displacements or rotation angle velocities in two of the sustaining rotation bodies, in which two sustaining rotation bodies the diameters thereof are different from each other and/or the degrees to which the pitch line distances of parts of the belt which parts wind around the two sustaining rotation bodies influence a relationship between the belt moving velocity and the rotation angle velocities of the two sustaining rotation bodies are different from each other; wherein the control unit controls a process, where one value corresponding to a certain parameter in two pieces of rotation fluctuation information whose phases are different and which information is included in the rotation information of the two sustaining rotation bodies is greater than the other value corresponding to the same parameter in the two pieces of the rotation fluctuation information, by obtaining the two pieces of the rotation fluctuation information, and controls the driving of the belt by using a result of the process.

2. The belt driving controller as claimed in claim 1, wherein:

the process by the control unit for obtaining the two pieces of the rotation fluctuation information includes;

an adding process; in which the rotation information is multiplied by a gain based on the degrees of the two sustaining rotation bodies and the multiplied result is delayed by a delay period during which the belt passes through a distance from a sustaining rotation body having a large diameter to a sustaining rotation body having a small diameter in the two sustaining rotation bodies on a belt moving route in the belt moving direction, and the delayed result is added to the rotation information;

the adding process is repeated "n" times ($n \geqq 1$) where in an $n^{th}$ adding process, the added result in an $(n-1)^{th}$ adding process is multiplied by the $2^{n-1}$ power of the gain, the multiplied result is delayed by ($2^{n-1}\times$the delay period), and the delayed result is added to the added result in the $(n-1)^{th}$ adding process; and the driving of the belt is controlled by using a result in which the added result in the $n^{th}$ adding process is divided by the $2^n$ power of the gain and the delay period generated in the adding process is corrected.

3. The belt driving controller as claimed in claim 1, wherein:

the process by the control unit for obtaining the two pieces of the rotation fluctuation information includes;

a converting process; in which the rotation information is multiplied by a gain based on the degrees of the two sustaining rotation bodies and the multiplied result is delayed by a delay period during which the belt passes through a distance from a sustaining rotation body having a large diameter to a sustaining rotation body having a small diameter in the two sustaining rotation bodies on a belt moving route in the belt moving direction, and the delayed result is added to the rotation information;

the converting process is repeated "n" times ($n \geqq 1$) where in an $n^{th}$ converting process, the added result in an $(n-1)^{th}$ process is multiplied by the gain, the multiplied result is delayed by the delay period, and the delayed result is added to the rotation information; and the driving of the belt is controlled by using a result in which the converted result in the $n^{th}$ converting process is divided by the (n+1) power of the gain and the delay period generated in the converting process is corrected.

4. The belt driving controller as claimed in claim 1, wherein:

the process by the control unit for obtaining the two pieces of the rotation fluctuation information includes;

a converting process; in which the rotation information is multiplied by a gain based on the degrees of the two sustaining rotation bodies and the multiplied result is delayed by a delay period during which the belt passes through a distance from a sustaining rotation body having a large diameter to a sustaining rotation body having a small diameter in the two sustaining rotation bodies on a belt moving route in the belt moving direction, and the delayed result is added to the rotation information;

the converting process is repeated "n" times (n≧1) where in an $n^{th}$ converting process, the added result in an $(n-1)^{th}$ adding process is multiplied by the gain, the multiplied result is delayed by the delay period, and the delayed result is added to the added result in the $(n-1)^{th}$ converting process; and the driving of the belt is controlled by using a result in which the converted result in the nth converting process is divided by the (n+1) power of the gain and the delay period generated in the converting process is corrected.

5. The belt driving controller as claimed in claim 1, further comprising:

a rotation fluctuation information storing unit which stores the rotation fluctuation information in a period during which the belt moves one round.

6. The belt driving controller as claimed in claim 5, wherein:

the control unit obtains new rotation fluctuation information at a timing when a difference between the rotation fluctuation information stored in the rotation fluctuation information storing unit and the newly obtained rotation fluctuation information exceeds a predetermined tolerance.

7. The belt driving controller as claimed in claim 5, wherein:

the rotation fluctuation information storing unit stores past rotation fluctuation information of one round of the belt; and the control unit controls the driving of the belt by using the past rotation fluctuation information and newly obtained rotation fluctuation information.

8. The belt driving controller as claimed in claim 1, wherein:

the control unit obtains new rotation fluctuation information at a predetermined timing.

9. The belt driving controller as claimed in claim 1, wherein:

the control unit controls the driving of the belt while obtaining the rotation fluctuation information.

10. A belt rotating device, comprising:

a plurality of sustaining rotation bodies which are rotated together with a movement of a belt;

the belt which is wound around the plural sustaining rotation bodies including a driving sustaining rotation body;

a driving source which supplies a driving force to the driving sustaining rotation body for driving the belt;

a belt driving controller which controls driving of the belt; and a detecting unit which detects at least one of rotation angle displacements and rotation angle velocities of two of the sustaining rotation bodies, in which two sustaining rotation bodies the diameters thereof are different from each other and/or the degrees to which pitch line distances or thicknesses of parts of the belt which parts wind around the two sustaining rotation bodies influence a relationship between the belt moving velocity and the rotation angle velocities of the two sustaining rotation bodies are different from each other; wherein the belt driving controller includes a control unit, which controls the driving of the belt so that a moving velocity fluctuation of the belt caused by a pitch line distance fluctuation in the belt circumference direction becomes small, based on the detected rotation angle displacements or the rotation angle velocities;

a rotation fluctuation information storing unit which stores the rotation fluctuation information in a period during which the belt moves one round, wherein the control unit controls a process, where one value in two pieces of rotation fluctuation information whose phases are different in the two sustaining rotation bodies is greater than the other value in the two pieces of the rotation fluctuation information, by obtaining the two pieces of the rotation fluctuation information, and controls the driving of the belt by using a result of the process, and the control unit obtains new rotation fluctuation information at a timing when a difference between the rotation fluctuation information stored in the rotation fluctuation information storing unit and the newly obtained rotation fluctuation information exceeds a predetermined tolerance.

11. The belt rotating device as claimed in claim 10, wherein:

the two sustaining rotation bodies are driven sustaining rotation bodies which are rotated together with the movement of the belt.

12. The belt rotating device as claimed in claim 10, wherein:

the driving source includes a feedback control unit which feeds back the rotation angle displacement or the rotation angle velocity by detecting its own rotation angle displacement or its own rotation angle velocity.

13. The belt rotating device as claimed in claim 10, wherein:

one of the two sustaining rotation bodies is the driving sustaining rotation body.

14. The belt rotating device as claimed in claim 10, further comprising:

a mark detecting unit which detects a mark formed on the belt for detecting a reference position on the belt; wherein the control unit of the belt driving controller obtains the rotation fluctuation information at a timing when the mark detecting unit detects the mark and controls the driving of the belt.

15. The belt rotating device as claimed in claim 10, wherein:

the control unit of the belt driving controller obtains a relationship between the rotation fluctuation information and a belt moving position based on a pre-obtained average time during which the belt moves one round or a pre-obtained circumference length of the belt, and controls the driving of the belt.

16. The belt rotating device as claimed in claim 10, wherein:

the belt has a seam part at least at one position in the belt circumference direction.

17. The belt rotating device as claimed in claim 10, wherein:

the belt has a plurality of layers in the thickness direction of the belt.

18. An image forming apparatus, comprising a latent image carrier formed of a belt which is wound around a plurality of sustaining rotation bodies;

a latent image forming unit which forms a latent image on the latent image carrier;

a developing unit which develops the latent image formed on the latent image carrier;

a transferring unit which transfers the developed latent image onto a recording medium; and the belt rotating device as claimed in claim 10 for driving the latent image carrier.

19. An image forming apparatus, comprising a latent image carrier which carries a latent image;

a latent image forming unit which forms the latent image on the latent image carrier;

a developing unit which develops the latent image formed on the latent image carrier;

an intermediate transfer body which is wound around a plurality of sustaining rotation bodies;

a first transferring unit which transfers the developed latent image formed on the latent image carrier onto the intermediate transfer body;

a second transferring unit which transfers the developed latent image from the first transferring unit onto a recording medium; and the belt rotating device as claimed in claim 10 for rotating the intermediate transfer body.

20. An image forming apparatus, comprising a latent image carrier which carries a latent image;

a latent image forming unit which forms the latent image on the latent image carrier;

a developing unit which develops the latent image formed on the latent image carrier;

a recording medium carrying unit formed of a belt which is wound around a plurality of sustaining rotation bodies for carrying a recording medium;

a transfer unit which transfers the latent image developed by the developing unit onto the recording medium carried by the recording medium carrying unit directly or via an intermediate transfer body; and the belt rotating device as claimed in claim 10 for rotating the recording medium carrying body.

* * * * *